US006554383B2

(12) United States Patent
Nagatomo et al.

(10) Patent No.: US 6,554,383 B2
(45) Date of Patent: Apr. 29, 2003

(54) LIQUID EJECTING HEAD AND HEAD CARTRIDGE CAPABLE OF ADJUSTING ENERGY SUPPLIED THERETO, LIQUID EJECTING DEVICE PROVIDED WITH THE HEAD AND HEAD CARTRIDGE, AND RECORDING SYSTEM

(75) Inventors: Akira Nagatomo, Yokohama (JP); Mikio Shiga, Yokohama (JP); Hiroyuki Ishinaga, Tokyo (JP); Shinya Matsui, Tokyo (JP); Toshio Kashino, Chigasaki (JP); Hiroshi Tajika, Yokohama (JP); Tetsushi Kohno, Tokyo (JP); Yoshie Asakawa, Hotaka-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/968,012

(22) Filed: Oct. 2, 2001

(65) Prior Publication Data

US 2002/0041296 A1 Apr. 11, 2002

Related U.S. Application Data

(60) Provisional application No. 08/891,323, filed on Jul. 10, 1997, now abandoned.

(30) Foreign Application Priority Data

Jul. 12, 1996 (JP) ..... 8-183042

(51) Int. Cl.[7] ..... B41J 29/38; B41J 29/393; B41J 2/05

(52) U.S. Cl. ..... 347/9; 347/19; 347/14; 347/65

(58) Field of Search ..... 347/9, 14, 19, 347/49, 65, 67, 57, 59

(56) References Cited

U.S. PATENT DOCUMENTS

| | | | |
|---|---|---|---|
| 4,480,259 A | 10/1984 | Kruger et al. | 347/63 |
| 4,496,960 A | 1/1985 | Fischbeck | 347/68 |

(List continued on next page.)

FOREIGN PATENT DOCUMENTS

| | | |
|---|---|---|
| EP | 0 419 191 | 3/1991 |
| EP | 0 436 047 | 7/1991 |
| EP | 0 443 798 | 8/1991 |
| EP | 0 496 533 | 7/1992 |
| EP | 0 504 879 | 9/1992 |
| EP | 0 538 147 | 4/1993 |
| EP | 0 641 656 | 3/1995 |
| EP | 0 650 837 | 5/1995 |
| JP | 61-59914 | 2/1980 |

(List continued on next page.)

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The present invention realizes a liquid ejecting head with increased ejection force and ejection efficiency and also realizes a liquid ejecting head having compatibility with the conventional products, and a head cartridge and a recording system incorporating the liquid ejecting head.

A liquid ejecting head or a head cartridge having an ejection outlet for ejecting a liquid, a liquid flow path in fluid communication with the ejection outlet, and an ejection energy generating element, provided corresponding to the liquid flow path, for receiving an electric signal to generate ejection energy, which comprises an energy adjusting device for adjusting an amount of energy supplied from the outside to the liquid ejecting head and utilized as the electric signal.

18 Claims, 13 Drawing Sheets

U.S. PATENT DOCUMENTS

| | | | | | |
|---|---|---|---|---|---|
| 4,509,063 | A | | 4/1985 | Sugitani et al. | 347/65 |
| 4,558,333 | A | | 12/1985 | Sugitani et al. | 347/65 |
| 4,568,953 | A | | 2/1986 | Aoki et al. | 347/65 |
| 4,611,219 | A | | 9/1986 | Sugitani et al. | 347/40 |
| 4,698,645 | A | | 10/1987 | Inamoto | 347/65 |
| 4,723,129 | A | | 2/1988 | Endo et al. | 347/56 |
| 4,723,136 | A | | 2/1988 | Suzumura | 347/65 |
| 4,963,883 | A | | 10/1990 | Matsui | 347/48 |
| 4,994,825 | A | | 2/1991 | Saito et al. | 347/63 |
| 5,166,699 | A | | 11/1992 | Yano et al. | 347/17 |
| 5,175,565 | A | | 12/1992 | Ishinaga et al. | 347/67 |
| 5,208,604 | A | | 5/1993 | Watanabe et al. | 347/47 |
| 5,235,351 | A | * | 8/1993 | Koizumi | 347/14 |
| 5,262,802 | A | | 11/1993 | Karita et al. | 347/87 |
| 5,278,585 | A | | 1/1994 | Karz et al. | 347/65 |
| 5,296,875 | A | | 3/1994 | Suda | 347/93 |
| 5,300,968 | A | | 4/1994 | Hawkins | 347/12 |
| 5,367,325 | A | | 11/1994 | Yano et al. | 347/17 |
| 5,389,957 | A | | 2/1995 | Kimura et al. | 347/20 |
| 5,448,153 | A | | 9/1995 | Ikeda et al. | 320/30 |
| 5,485,184 | A | | 1/1996 | Nakagomi et al. | 347/63 |
| 5,485,186 | A | | 1/1996 | Ishinaga et al. | 347/65 |
| 5,506,611 | A | * | 4/1996 | Ujita et al. | 347/19 |
| 5,565,899 | A | | 10/1996 | Sugimoto et al. | 347/30 |
| 5,602,576 | A | | 2/1997 | Murooka et al. | 347/59 |
| 5,821,962 | A | | 10/1998 | Kudo et al. | 347/65 |
| 5,943,074 | A | | 8/1999 | Kashino et al. | 347/54 |
| 6,007,187 | A | | 12/1999 | Kashino et al. | 347/65 |
| 6,062,680 | A | | 5/2000 | Yoshihira et al. | 347/65 |
| 6,070,970 | A | | 6/2000 | Ogasawara et al. | 347/65 |
| 6,074,543 | A | | 6/2000 | Yoshihira et al. | 205/75 |
| 6,095,639 | A | | 8/2000 | Uetsuki et al. | 347/65 |
| 6,102,529 | A | | 8/2000 | Okazaki et al. | 347/65 |
| 6,106,111 | A | | 8/2000 | Taneya et al. | 347/86 |
| 6,109,718 | A | | 8/2000 | Murakami et al. | 347/14 |
| 6,109,735 | A | | 8/2000 | Kashino et al. | 347/65 |
| 6,113,224 | A | | 9/2000 | Sugama et al. | 347/65 |
| 6,151,049 | A | | 11/2000 | Karita et al. | 347/65 |
| 6,154,237 | A | | 11/2000 | Kashio et al. | 347/48 |
| 6,164,763 | A | | 12/2000 | Sugama et al. | 347/63 |
| 6,168,264 | B1 | | 1/2001 | Yoshihira et al. | 347/65 |
| 6,183,068 | B1 | | 2/2001 | Kashino et al. | 347/65 |
| 6,206,508 | B1 | | 3/2001 | Asakawa et al. | 347/65 |
| 6,213,592 | B1 | | 4/2001 | Takenouchi et al. | 347/65 |
| 6,252,616 | B1 | | 6/2001 | Okazaki et al. | 347/65 |
| 6,270,199 | B1 | | 8/2001 | Kimura et al. | 347/65 |
| 6,302,518 | B1 | | 10/2001 | Kudo et al. | 347/42 |
| 6,305,789 | B1 | | 10/2001 | Nakata et al. | 347/61 |
| 6,312,111 | B1 | | 11/2001 | Kimura et al. | 347/65 |
| 6,318,848 | B1 | | 11/2001 | Iwasaki et al. | 347/65 |
| 6,331,050 | B1 | | 12/2001 | Nakata et al. | 347/65 |
| 6,334,669 | B1 | | 1/2002 | Kudo et al. | 347/65 |

FOREIGN PATENT DOCUMENTS

| | | |
|---|---|---|
| JP | 55-81172 | 6/1980 |
| JP | 61-69467 | 4/1986 |
| JP | 61-110557 | 5/1986 |
| JP | 62-37163 | 2/1987 |
| JP | 62-151349 | 7/1987 |
| JP | 62-156969 | 7/1987 |
| JP | 62-48585 | 10/1987 |
| JP | 63-197652 | 8/1988 |
| JP | 63-199972 | 8/1988 |
| JP | 2-113950 | 4/1990 |
| JP | 3-81155 | 4/1991 |
| JP | 3-114762 | 5/1991 |
| JP | 5-124189 | 5/1993 |
| JP | 5-169663 | 7/1993 |
| JP | 6-31918 | 2/1994 |
| JP | 6-87214 | 3/1994 |

* cited by examiner

LIQUID EJECTING HEAD AND HEAD CARTRIDGE CAPABLE OF ADJUSTING ENERGY SUPPLIED THERETO, LIQUID EJECTING DEVICE PROVIDED WITH THE HEAD AND HEAD CARTRIDGE, AND RECORDING SYSTEM

This application is a continuation of application Ser. No. 08/891,323, filed on Jul. 10, 1997, now abandoned.

BACKGROUND OF THE INVENTION

1. Field of the Invention

The present invention relates to a liquid ejecting head for ejecting a desired liquid by generation of bubble occurring when thermal energy is exerted on the liquid and to a head cartridge and a liquid ejecting device incorporating the liquid ejecting head.

More specifically, the present invention relates to a liquid ejecting head capable of replaceably being mounted on a plurality of devices and to a head cartridge and a liquid ejecting device incorporating the liquid ejecting head.

The present invention is the invention that can be applied to liquid ejecting heads having movable members arranged to be displaced by use of the generation of bubble, and the like.

The present invention is the invention applicable to equipment such as a printer, a copying machine, a facsimile machine having a communication system, a word processor having a printer portion or the like, and an industrial recording device combined with one or more of various processing devices, with which recording is effected on a recording medium such as paper, thread, fiber, textile, leather, metal, plastic material, glass, wood, ceramic material, and so on.

It is noted here that "recording" in the present invention means not only provision of an image having meaning, such as characters or graphics, on a recorded medium, but also provision of an image having no meaning, such as patterns, on the medium.

2. Related Background Art

One of the conventionally known recording methods is an ink jet recording method for imparting energy of heat or the like to ink, using a heat generating element as an energy generating element, so as to cause a state change accompanied by a quick volume change of ink (generation of bubble), thereby ejecting the ink through an ejection outlet by acting force based on this state change, and depositing the ink on a recorded medium, thereby forming an image, which is so called as a bubble jet recording method. A recording apparatus using this bubble jet recording method is normally provided, as disclosed in the bulletin of U.S. Pat. No. 4,723,129 etc., with ejection outlets for ejecting the ink, ink flow paths in communication with the respective ejection outlets, and electrothermal transducers as energy generating means for ejecting the ink located in the ink flow path.

Another known method is ink jet ejection with a piezo-element as an energy generating element to eject ink by mechanical displacement of the piezo-element.

Particularly, the bubble jet recording method permits high-quality images to be recorded at high speed and with low noise and in addition, because a head for carrying out this recording method can have the ejection outlets for ejecting the ink as disposed in high density, it has many advantages; for example, high-resolution recorded images or even color images can be obtained readily by compact apparatus. Therefore, this bubble jet recording method is used in many office devices including printers, copiers, facsimile machines, and so on in recent years and further is becoming to be used for industrial systems such as textile printing apparatus.

With spread of use of the ink jet technology such as the bubble jet technology in products in wide fields, a variety of demands described below are increasing these years.

Especially, in the case of the conventional ink jet devices, the most of them allowed fixed voltage and current of electric energy to be received by the ink jet head mounted in the device, so that the mountable ink jet head was fixed for every ink jet device. There were proposals of some ink jet heads capable of being mounted on plural devices, but in such cases, the devices were arranged to supply common energy to the ink jet heads.

It was, however, not possible to apply a common head to devices different in energy quantity supplied to the head, for example, to a plurality of devices of different supply voltages.

Especially, under such circumstances that energy saving of device itself was intended as also in recent years, there was a problem to be solved that when a head compatible with a device designed in an energy-saving arrangement was attempted to be applied to another device produced without design of such energy-saving arrangement, the head did not work well.

Returning to the principle of liquid droplet ejection, some of the inventors reviewed the fundamental ejection characteristics of the conventional method for ejecting the liquid by forming the basically conventional bubble (especially, the bubble generated upon film boiling) in the liquid flow path, and proposed the liquid ejecting method for arranging the movable member so as to face the bubble generation region and for positively controlling the bubble, thereby greatly improving the ejection efficiency etc.

A novel ink jet head employing such a liquid ejecting method with improved ejection efficiency can achieve stable ejection performance of ink by lower power than the conventional ink jet heads. Therefore, printers ready for the novel ink jet head permit driving voltage for ejection of ink to be set lower, thereby achieving power saving. However, printers ready for the conventional ink jet heads had a problem that they were unable to use the novel ink jet head, because of the difference in driving power.

In order to allow mounting of the both conventional ink jet head and novel ink jet head with improved ejection efficiency, it is also conceivable to provide a plurality of power supply systems inside a recording apparatus so as to be ready for future ink jet heads of lowered driving power, but it is not preferable because of problems of increase in cost and increase in the size of apparatus.

SUMMARY OF THE INVENTION

It is also a subject of the present invention to enable a liquid ejecting head with high ejection efficiency capable of achieving energy saving to be mounted on various types of devices.

A first object of the present invention is to provide a liquid ejecting head and a head cartridge capable of performing good ejection, that can be mounted on devices mutually different in quantity of electric energy supplied to the liquid ejecting head.

A second object of the present invention is to provide a liquid ejecting head etc. applicable to various devices by improving the novel liquid ejecting head with increased ejection efficiency and ejection pressure, based on basic control of the generated bubble.

A third object of the present invention is to provide a liquid ejecting head etc. that can adjust the electric energy received from a device on which the head is mounted, to an appropriate energy quantity.

Typical features of the present invention for achieving the above objects are as follows.

The present invention provides a liquid ejecting head comprising an ejection outlet for ejecting a liquid, a liquid flow path in fluid communication with the ejection outlet, and an ejection energy generating element provided corresponding to the liquid flow path and arranged to receive an electric signal to generate ejection energy, the liquid ejecting head having energy adjusting means for adjusting a quantity of energy supplied from the outside to the liquid ejecting head and utilized as said electric signal.

The present invention also provides a liquid ejecting head that can be replaceably mounted on a plurality of devices.

The present invention also provides a liquid ejecting head in which the foregoing ejection energy generating element is a heat generating element, which supplies thermal energy to the liquid supplied into the liquid flow path to generate a bubble therein and to eject the liquid through the ejection outlet by pressure upon generation of the bubble.

The present invention also provides a liquid ejecting head in which the foregoing energy adjusting means is means for converting a voltage of the aforementioned energy.

The present invention also provides a liquid ejecting head for ejecting ink as the liquid.

The present invention also provides a head cartridge comprising the liquid ejecting head constructed in either one of the above configurations, and a liquid container for reserving a liquid to be supplied to the liquid ejecting head.

The present invention also provides a liquid ejecting device comprising the liquid ejecting head constructed in either one of the above configurations, and energy supplying means for supplying the aforementioned energy to the liquid ejecting head.

The present invention also provides a liquid ejecting head comprising an ejection outlet for ejecting a liquid, a heat generating element for supplying heat to a liquid to generate a bubble in the liquid, and a movable member disposed so as to face said heat generating element, having a free end on the ejection outlet side, and arranged to displace said free end, based on pressure resulting from generation of the bubble, thereby guiding said pressure to the ejection outlet side, the liquid ejecting head having energy adjusting means for adjusting a quantity of energy supplied from the outside to said liquid ejecting head and utilized as an electric signal applied to said heat generating element.

The present invention also provides a liquid ejecting head in which the aforementioned energy adjusting means is means for adjusting a voltage of said energy.

The present invention also provides a liquid ejecting head in which the free end of said movable member is located downstream of a center of an area of said heat generating element.

The present invention also provides a liquid ejecting head in which said bubble is a bubble generated when film boiling occurs in the liquid by the heat generated by the heat generating element.

The present invention also provides a liquid ejecting head in which said movable member is of a plate shape.

The present invention also provides a liquid ejecting head in which said movable member is constructed as a part of a partition wall disposed between a first flow path and a second flow path.

The present invention also provides a liquid ejecting head in which the voltage converting means is constructed by use of a voltage divider.

The present invention also provides a liquid ejecting head in which the voltage converting means is constructed by use of a DC-DC converter.

The present invention also provides a head cartridge comprising the liquid ejecting head constructed in either one of the above configurations, and a liquid container for reserving a liquid to be supplied to the liquid ejecting head.

The present invention also provides a liquid ejecting device comprising the liquid ejecting head constructed in either one of the above configurations, and energy supplying means for supplying said energy to the liquid ejecting head.

The present invention also provides a recording system comprising:

means for replaceably mounting said liquid ejecting head;

said liquid ejecting head outputting an ID signal indicating a type of the liquid ejecting head mounted, said liquid ejecting device having controlling means for identifying the type of the liquid ejecting head from presence or absence of said ID signal and output contents thereof and for controlling a width of a pulse signal supplied to said liquid ejecting head in accordance with the identified type.

[Function]

The above-stated configurations enable the head to be mounted on various devices, even in the case wherein the head is mounted on the plural devices arranged to supply different electric energies, because the head itself adjusts the energy received from the device side.

In addition, the liquid ejecting method, head, etc. according to the present invention, based on the very novel ejection principle, can attain the synergistic effect of the bubble generated and the movable member displaced thereby, so that the liquid near the ejection outlet can be ejected efficiently, thereby improving the ejection efficiency as compared with the conventional ejection methods, heads, and so on of the bubble jet type. For example, the most preferable form of the present invention achieved the breakthrough ejection efficiency two or more times improved.

With the head of the invention described, therefore, the head can be driven by lower energy than heretofore.

In order to provide the ejecting head of improved ejection efficiency with capability of replacing the conventional heads so as to be mounted on the conventional devices, it has the adjusting means for adjusting the energy received by the head. Since the head is capable of ejecting the liquid by lower energy because of the high ejection efficiency, the adjusting means is for adjusting (or lowering) the energy supplied to the recording head when the head is mounted on the recording apparatus in the same manner as the conventional heads, for allowing the head of the invention to replace the conventional heads. The above-stated configuration permits the ejecting head of the present invention to be handled in the same way as the conventional heads.

The other effects of the present invention will be understood from the description of the embodiments.

The terms "upstream" and "downstream" used in the description of the invention are defined with respect to the direction of general liquid flow from a liquid supply source through the bubble generation region (or the movable member) to the ejection outlet or are expressed as expressions as to this structural direction.

Further, the "downstream side" of the bubble itself represents an ejection-outlet-side portion of the bubble which directly functions mainly to eject a liquid droplet. More particularly, it means a downstream portion of the bubble in the above flow direction or in the above structural direction with respect to the center of the bubble, or a bubble appearing in the downstream region from the center of the area of the heat generating element.

A "substantially sealed" state used in the description of the invention generally means a sealed state in such a degree that while a bubble grows, the bubble is kept from escaping through a gap (slit) around the movable member before displacement of the movable member.

The "partition wall" stated in the invention may mean a wall (which may include the movable member) interposed to separate the region in direct fluid communication with the ejection outlet from the bubble generation region in a wide sense and, more specifically, means a wall for separating the liquid flow path including the bubble generation region from the liquid flow path in direct fluid communication with the ejection outlet, thereby preventing mixture of the liquids in the respective liquid flow paths, in a narrow sense.

DETAILED DESCRIPTION OF THE PREFERRED EMBODIMENTS

Embodiment 1

Figure 1A:
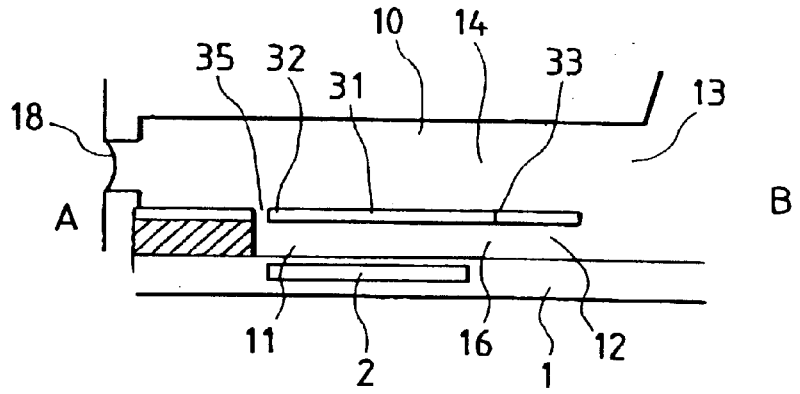
FIGS. 1A, 1B, 1C and 1D are schematic, cross-sectional views to show an example of a novel liquid ejecting head to which the present invention is applied.

The first embodiment of the present invention will be described in detail with reference to the drawings.

First described are a typical example of the novel liquid ejecting head that achieved the increase of ejection efficiency, as an ink jet head to which the present invention can be applied, and the driving principle thereof.

FIGS. 1A to 1D are schematic, sectional views, cut along the direction of liquid flow path, of a liquid ejecting head of the present embodiment applicable to the invention described above, and FIG. 2 is a perspective view, partly broken, of the liquid ejecting head of the present embodiment.

The liquid ejecting head of the present embodiment comprises an element substrate 1, heat generating elements 2 (heating resistor members in the configuration of 40 $\mu$m×105 $\mu$m in the present embodiment) as ejection energy generating elements for supplying thermal energy to the liquid to eject the liquid, mounted on the element substrate 1, and liquid flow paths 10 formed above the element substrate in correspondence to the heat generating elements 2. The liquid flow paths 10 are in fluid communication with associated ejection outlets 18 and with a common liquid chamber 13 for supplying the liquid to the plurality of liquid flow paths 10, so that each liquid flow path 10 can receive the liquid from the common liquid chamber 13 in an amount equivalent to the liquid having been ejected through the ejection outlet 18.

Above the element substrate and in each liquid flow path 10 a movable member 31 of a plate shape having a flat surface portion is formed in a cantilever form and of a material having elasticity, such as metal, so as to face the above heat generating element 2. One end of the movable member 31 is fixed to foundations (support member) 34 or the like provided by patterning of a photosensitive resin on the wall of the liquid flow path 10 or on the element substrate. This structure supports the movable member and constitutes a fulcrum (fulcrum portion) 33.

The movable member 31 has the fulcrum (fulcrum portion: fixed end) 33 on the upstream side of a large flow of the liquid from the common liquid chamber 13 via the movable member 31 toward the ejection outlet 18, caused by the ejection operation of the liquid, and has a free end (free end portion) 32 on the downstream side with respect to this fulcrum 33. The movable member 31 is so positioned that it is opposed to the heat generating element 2 with a space of approximately 15 $\mu$m therefrom so as to cover the heat generating element. A bubble generation region is defined between the heat generating element and the movable member. The type, configuration, and position of the heat generating element or the movable member are not limited to those described above, but may be arbitrarily determined as long as the configuration and position are suitable for controlling the growth of bubble and the propagation of pressure as discussed below. For the convenience' sake of description of the flow of the liquid discussed hereinafter, the liquid flow path 10 as described is divided by the movable member 31 into two regions, i.e., a first liquid flow path 14 in direct communication with the ejection outlet 18 and a second liquid flow path 16 having the bubble generation region 11 and the liquid supply passage 12.

Figure 1B:
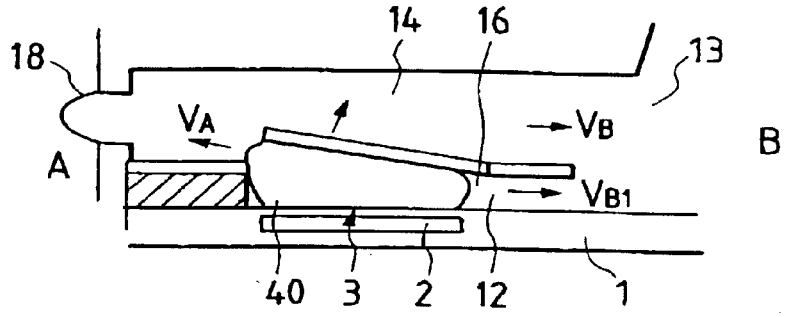
Figure 1C:
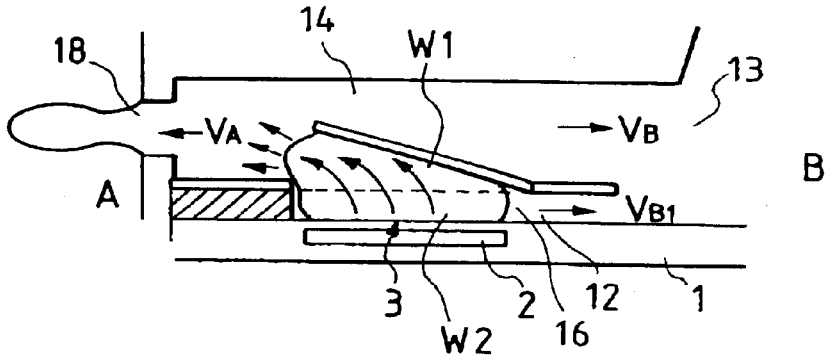
Figure 2:
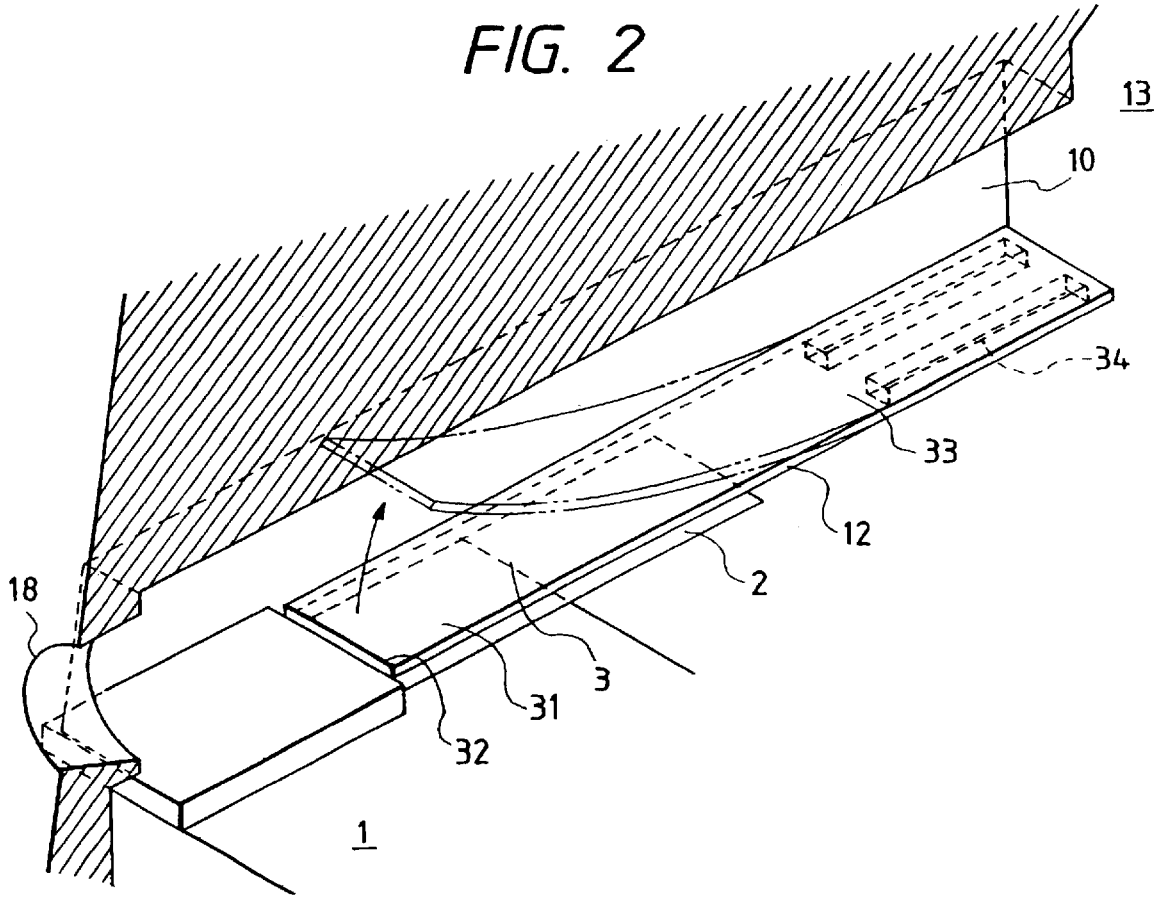
FIG. 2 is a perspective view, partly broken, of the novel liquid ejecting head to which the present invention is applied.

By heating the heat generating element 2, heat is applied to the liquid in the bubble generation region 11 between the movable member 31 and the heat generating element 2, whereby a bubble is generated in the liquid by the film boiling phenomenon as described in U.S. Pat. No. 4,723,129. The bubble and the pressure based on the generation of bubble preferentially act on the movable member, so that the movable member 31 is displaced to widely open on the ejection outlet side about the fulcrum 33, as shown in FIGS. 1B and 1C or FIG. 2. The displacement or the displaced state of the movable member 31 guides the growth of the bubble itself and the propagation of the pressure raised with generation of the bubble toward the ejection outlet.

Here, one of the fundamental ejection principles adopted in the liquid ejecting head described above will be explained. One of the important principles is that with the pressure of the bubble or the bubble itself the movable member disposed to face the bubble is displaced from a first position in a stationary state to a second position in a state after displaced and that the movable member 31 thus displaced guides the bubble itself or the pressure caused by the generation of bubble toward the downstream side where the ejection outlet 18 is positioned.

Figure 3:
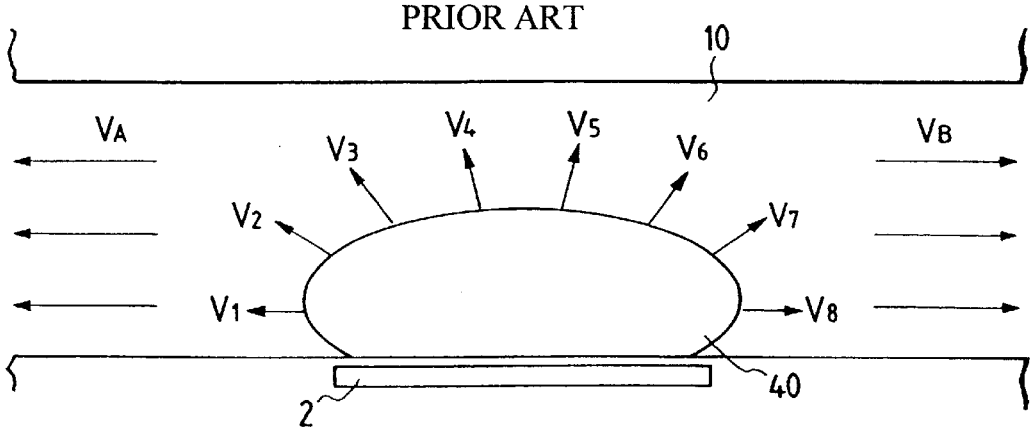
FIG. 3 PRIOR ART
FIG. 3 is a schematic diagram to show propagation of pressure from the bubble in the conventionally known head.
Figure 4:
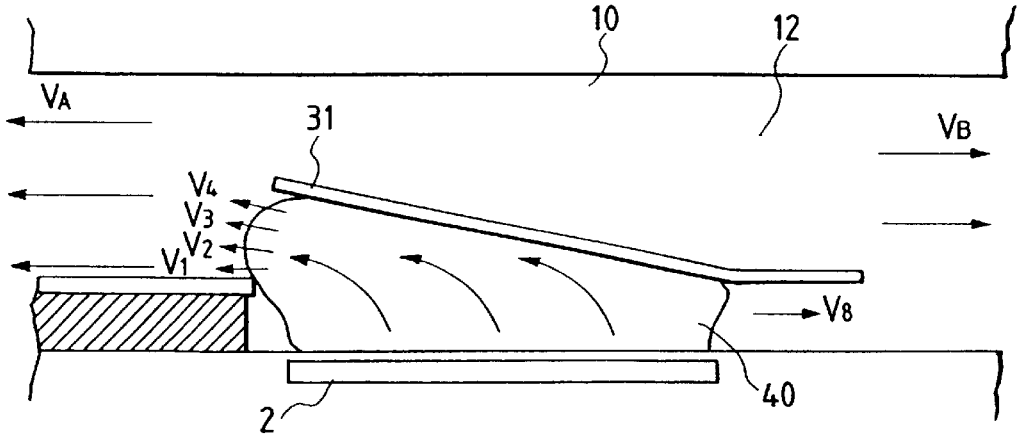
FIG. 4 is a schematic diagram to show propagation of pressure from the bubble in the novel liquid ejecting head to which the present invention is applied.

The principle will be explained in further detail, comparing FIG. 4 showing a head applicable to the present invention with FIG. 3 schematically showing the conventional liquid flow path structure without the movable member. In these figures, a propagation direction of the pressure toward the ejection outlet is indicated by $V_A$ and a propagation direction of the pressure toward upstream by $V_B$.

The conventional head shown in FIG. 3 has no structure for regulating directions of propagation of the pressure raised by the bubble 40 generated. Thus, the pressure of the bubble 40 propagates in various directions normal to the surface of the bubble as shown by $V_1$–$V_8$. Among these, components having the pressure propagation directions along the direction $V_A$ most effective to the liquid ejection are those having the directions of propagation of the pressure in the portion of the bubble closer to the ejection outlet than the nearly half point, i.e., $V_1$–$V_4$, which is an important portion directly contributing to the liquid ejection efficiency, the liquid ejection force, the ejection speed, and so on. Further, $V_1$ effectively acts because it is closest to the ejection direction $V_A$, and on the other hand, $V_4$ involves a relatively small component directed in the direction of $V_A$.

In contrast with it, in the case of the present invention shown in FIG. 4, the movable member 31 works to guide the pressure propagation directions $V_1$–$V_4$ of bubble, which would be otherwise directed in the various directions as in the case of FIG. 3, toward the downstream side (the ejection outlet side) so as to change them into the pressure propagation direction of $V_A$, thereby making the pressure of bubble 40 contribute directly and effectively to ejection. The growing directions per se of the bubble are guided to the downstream in the same manner as the pressure propagation directions $V_1$–$V_4$ are, so that the bubble grows more on the downstream side than on the upstream side. In this manner, the ejection efficiency, the ejection force, the ejection speed, and so on can be fundamentally improved by controlling the growing directions per se of bubble by the movable member and thereby controlling the pressure propagation directions of bubble.

Now returning to FIGS. 1A to 1D, the ejection operation of the liquid ejecting head will be described in detail.

FIG. 1A shows a state seen before the energy such as electric energy is applied to the heat generating element 2, which is, therefore, a state seen before the heat generating element generates the heat. An important point herein is that the movable member 31 is positioned relative to the bubble generated by heat of the heat generating element so as to be opposed to at least the downstream side portion of the bubble. Namely, in order to let the downstream portion of the bubble act on the movable member, the liquid flow passage structure is arranged in such a way that the movable member 31 extends at least up to a position downstream of the center 3 of the area of the heat generating element (or downstream of a line passing through the center 3 of the area of the heat generating element and being perpendicular to the lengthwise direction of the flow path).

FIG. 1B shows a state in which the electric energy or the like is applied to the heat generating element 2 to heat the heat generating element 2 and the heat thus generated heats a part of the liquid filling inside of the bubble generation region 11 to generate a bubble in accordance with film boiling.

At this time the movable member 31 is displaced from the first position to the second position by the pressure raised by generation of bubble 40 so as to guide the propagation directions of the pressure of the bubble 40 into the direction toward the ejection outlet. An important point here is, as described above, that the free end 32 of the movable member 31 is located on the downstream side (or on the ejection outlet side) with the fulcrum 33 on the upstream side (or on the common liquid chamber side) so that at least a part of the movable member may be opposed to the downstream portion of the heat generating element, that is, to the downstream portion of the bubble.

FIG. 1C shows a state in which the bubble 40 has further grown and the movable member 31 is further displaced according to the pressure raised by generation of bubble 40. The bubble generated grows more downstream than upstream to expand largely beyond the first position (the position of the dotted line) of the movable member. It is thus understood that the gradual displacement of the movable member 31 in response to the growth of bubble 40 allows the pressure propagation directions of bubble 40 and easily volume-changing directions, i.e., the growing directions of bubble to the free end side, to be uniformly directed toward the ejection outlet, which also increases the ejection efficiency. While the movable member guides the bubble and the bubble generation pressure toward the ejection outlet, it rarely obstructs the propagation and growth and it can efficiently control the propagation directions of the pressure and the growth directions of the bubble in accordance with the magnitude of the pressure propagating.

Figure 1D:
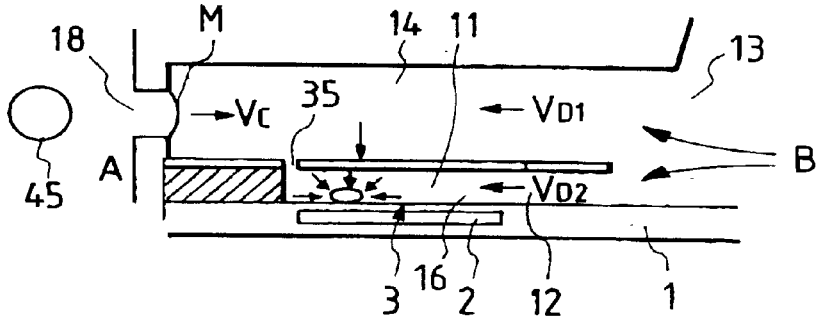

FIG. 1D shows a state in which the bubble 40 contracts and extincts because of a decrease of the pressure inside the bubble after the film boiling stated previously.

The movable member 31 having been displaced to the second position returns to the initial position (the first position) of FIG. 1A by restoring force resulting from the spring property of the movable member itself and the negative pressure due to the contraction of the bubble. Upon collapse of the bubble the liquid flows into the bubble generation region 11 in order to compensate for the volume reduction of the bubble and in order to compensate for the volume of the liquid ejected, as indicated by the flows $V_{D1}$, $V_{D2}$ from the upstream side (B) or the common liquid chamber side and by the flow $V_c$ from the ejection outlet side.

The foregoing explained the operation of the movable member with generation of the bubble and the ejecting operation of the liquid, and then the following explains a refilling mechanism of the liquid in the liquid ejecting head applicable to the present invention.

After FIG. 1C, the bubble 40 experiences a state of the maximum volume and then enters a bubble collapsing process. In the bubble collapsing process, the volume of the liquid enough to compensate for the volume of the bubble having collapsed flows into the bubble generation region from the ejection outlet 18 side of the first liquid flow path 14 and from the side of the common liquid chamber 13 of the second liquid flow path 16. In the case of the conventional liquid flow passage structure having no movable member 31, amounts of the liquid flowing from the ejection outlet side and from the common liquid chamber into the bubble collapsing position depend upon magnitudes of flow resistances in the portions closer to the ejection outlet and closer to the common liquid chamber than the bubble generation region (which are based on resistances of flow paths and inertia of the liquid).

If the flow resistance is smaller on the side near the ejection outlet, the liquid flows more into the bubble collapsing position from the ejection outlet side so as to increase an amount of retraction of meniscus. Particularly, as the flow resistance near the ejection outlet is decreased so as to raise the ejection efficiency, the retraction of meniscus M becomes greater upon collapse of bubble and the period of refilling time becomes longer, thus becoming a hindrance against high-speed printing.

In contrast with it, because the aforementioned head includes the movable member 31, the retraction of meniscus stops when the movable member returns to the initial position upon collapse of bubble; and thereafter the supply of the liquid for the remaining volume of W2 mainly relies on the liquid supply from the flow $V_{D2}$ through the second flow path 16, where the volume W of the bubble is split into the upper volume W1 beyond the first position of the movable member 31 and the lower volume W2 on the side of the bubble generation region 11. The retraction of meniscus appeared in the volume equivalent to approximately a half of the volume W of bubble in the conventional structure, whereas the above structure enabled to reduce the retraction of meniscus to a smaller volume, specifically, to approximately a half of W1.

Additionally, the liquid supply for the volume W2 can be forced, using the pressure upon collapse of bubble, along the surface of the movable member 31 on the heat generating element side and mainly from the upstream side ($V_{D2}$) of the second liquid flow path, thus realizing faster refilling.

A characteristic point here is as follows: if refilling is carried out using the pressure upon collapse of bubble in the conventional head, vibration of meniscus will be so great as to result in deteriorating the quality of image; whereas, high-speed refilling as in the aforementioned head can decrease the vibration of meniscus to an extremely low level, because the movable member restricts the flow of the liquid in the region of the first liquid flow path 14 on the ejection outlet side and in the region on the ejection outlet side of the bubble generation region 11.

In this way the above-stated example achieves the forced refilling of the liquid into the bubble generation region through the liquid supply passage 12 of the second flow path 16 and the suppression of the retraction and vibration of meniscus as discussed above, so as to perform high-speed refilling, whereby it can realize stable ejection and high-speed repetitive ejections and it can also realize an improvement in quality of image and high-speed recording when employed in applications in the field of recording.

The aforementioned head is also provided with a further effective function as follows. It is to suppress propagation of the pressure raised by generation of bubble to the upstream side (the back wave). The most of the pressure of the bubble on the side of the common liquid chamber 13 (or on the upstream side) in the bubble generated above the heat generating element 2 conventionally became the force to push the liquid back to the upstream side (which is the back wave). This back wave raised the upstream pressure and the liquid moving amount thereby and caused inertial force due to movement of the liquid, which degraded the refilling of the liquid into the liquid flow path and also hindered high-speed driving. In the aforementioned head, first, the movable member 31 suppresses the aforementioned actions to the upstream side, which also improves the refilling performance furthermore.

Next explained are further characteristic structures and effects of the aforementioned head.

The second liquid flow path 16 has the liquid supply passage 12 having an internal wall, which is substantially flatly continuous from the heat generating element 2 (which means that the surface of the heat generating element is not stepped down too much), on the upstream side of the heat generating element 2. In this case, the liquid is supplied to the bubble generation region 11 and the surface of the heat generating element 2 along the surface of the movable member 31 near the bubble generation region 11, as indicated by $V_{D2}$. This suppresses stagnation of the liquid above the surface of the heat generating element 2 and easily removes the so-called residual bubbles which are separated out from the gas dissolved in the liquid or which remain without being collapsed. Further, the heat is prevented from accumulating in the liquid. Accordingly, stabler generation of bubble can be repeated at high speed. Although the above example was explained with the liquid supply passage 12 having the substantially flat internal wall, without having to be limited to this, the liquid supply passage may be any passage with a gently sloping internal wall smoothly connected to the surface of the heat generating element as long as it is shaped so as not to cause stagnation of the liquid above the heat generating element or great turbulent flow in the supply of liquid.

There occurs some supply of the liquid into the bubble generation region in $V_{D1}$ through the side of the movable member (through the slit 35). In order to guide the pressure upon generation of bubble more effectively to the ejection outlet, such a movable member as to cover the whole of the bubble generation region (as to cover the surface of the heat generating element), as shown in FIGS. 1A to 1D, may be employed. If the arrangement in that case is such that when the movable member 31 returns to the first position, the flow resistance of the liquid is greater in the bubble generation region 11 and in the region near the ejection outlet of the first liquid flow path 14, the liquid will be restricted from flowing in $V_{D1}$ toward the bubble generation region 11 as described above. Since the head structure described above secures the flow $V_{D2}$ for supplying the liquid to the bubble generation region, it has very high supply performance of the liquid. Thus, the supply performance of the liquid can be maintained even in the structure with improved ejection efficiency in which the movable member 31 covers the bubble generation region 11.

Figure 5:
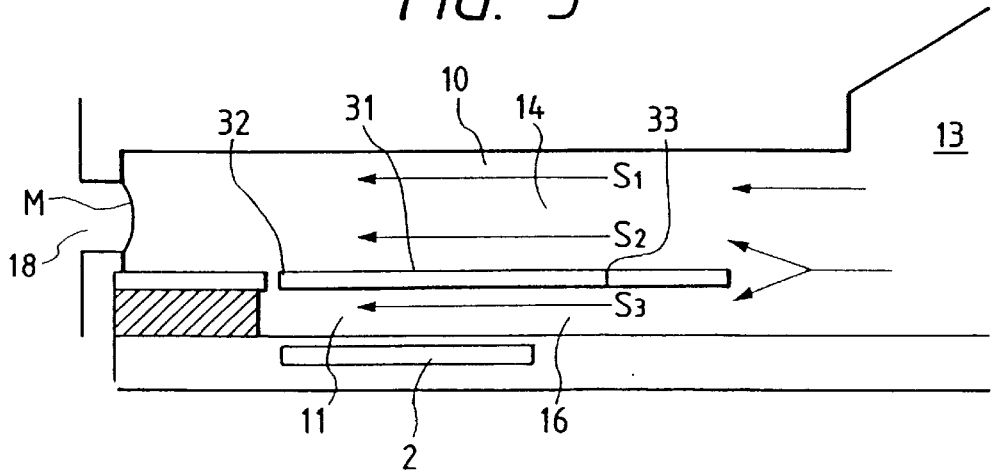
FIG. 5 is a schematic diagram for explaining flow of the liquid in the novel liquid ejecting head to which the present invention is applied.

Incidentally, the positional relation between the free end 32 and the fulcrum 33 of the movable member 31 is defined in such a manner that the free end is located downstream relative to the fulcrum, for example as shown in FIG. 5. This structure can efficiently realize the function and effect to guide the pressure propagation directions and the growing directions of the bubble to the ejection outlet 18 upon generation of bubble, as discussed previously. Further, this positional relation achieves not only the function and effect for ejection, but also the effect of high-speed refilling as decreasing the flow resistance against the liquid flowing in the liquid flow path 10 upon supply of liquid. This is because, as shown in FIG. 5, the free end and fulcrum 33 are positioned so as not to resist the flows S1, S2, S3 in the liquid flow path 10. (including the first liquid flow path 14 and the second liquid flow path 16) when the meniscus M at a retracted position after ejection returns to the ejection outlet 18 because of the capillary force or when the liquid is supplied to compensate for the collapse of bubble.

Explaining in further detail, in FIGS. 1A to 1D of the present embodiment the movable member 31 extends relative to the heat generating element 2 so that the free end 32 thereof is opposed thereto at a downstream position with respect to the area center 3 (the line passing through the center of the area of the heat generating element (through the central portion) and being perpendicular to the lengthwise direction of the liquid flow path), which separates the heat generating element 2 into the upstream region and the downstream region, as described previously. This arrangement causes the movable member 31 to receive the pressure or the bubble occurring downstream of the area center position 3 of the heat generating element and greatly contributing to the ejection of liquid and to guide the pressure and bubble toward the ejection outlet, thus fundamentally improving the ejection efficiency and the ejection force.

Further, many effects are attained by also utilizing the above-stated upstream portion of the bubble in addition.

It is presumed that effective contribution to the ejection of liquid also results from instantaneous mechanical displacement of the free end of the movable member 31 in the structure of the present embodiment.

Since the head described above has high ejection efficiency, an energy consumption amount can be small upon drive of head, so that the head can achieve energy saving.

Next described is another head that can also achieve energy saving, similar to the above head.

In the following example of the head the principal ejection principle of liquid is also the same as in the foregoing embodiment, but this example employs the double-flow-path structure of liquid flow path, thereby enabling to separate the liquid (bubble generation liquid) for forming the bubble by application of heat thereto, from the liquid (ejection liquid) to be ejected mainly.

Figure 6:
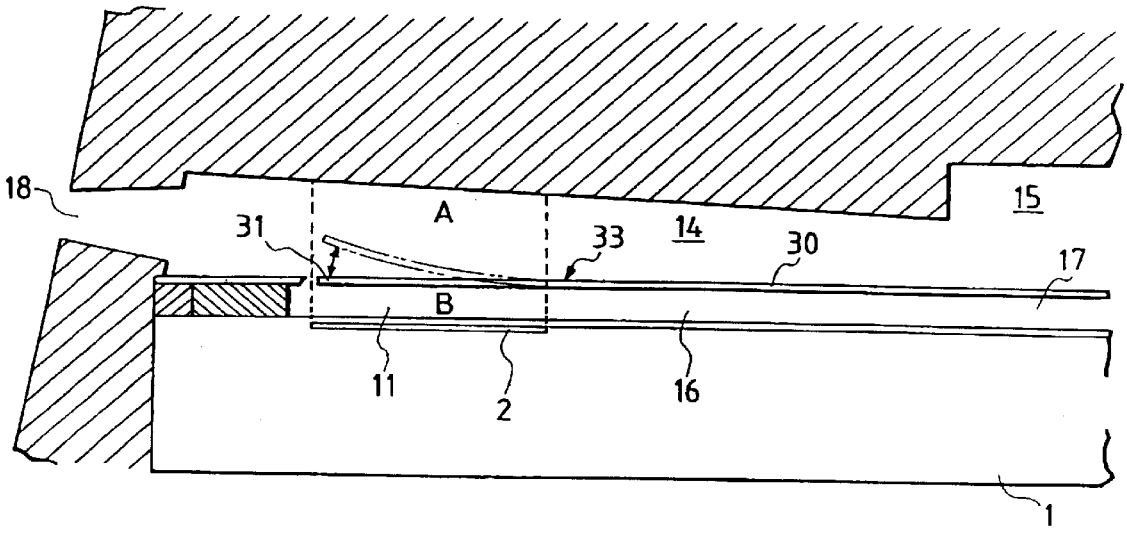
FIG. 6 is a cross-sectional view of a novel liquid ejecting head (of two liquid flow paths) to which the present invention is applied.
Figure 7:
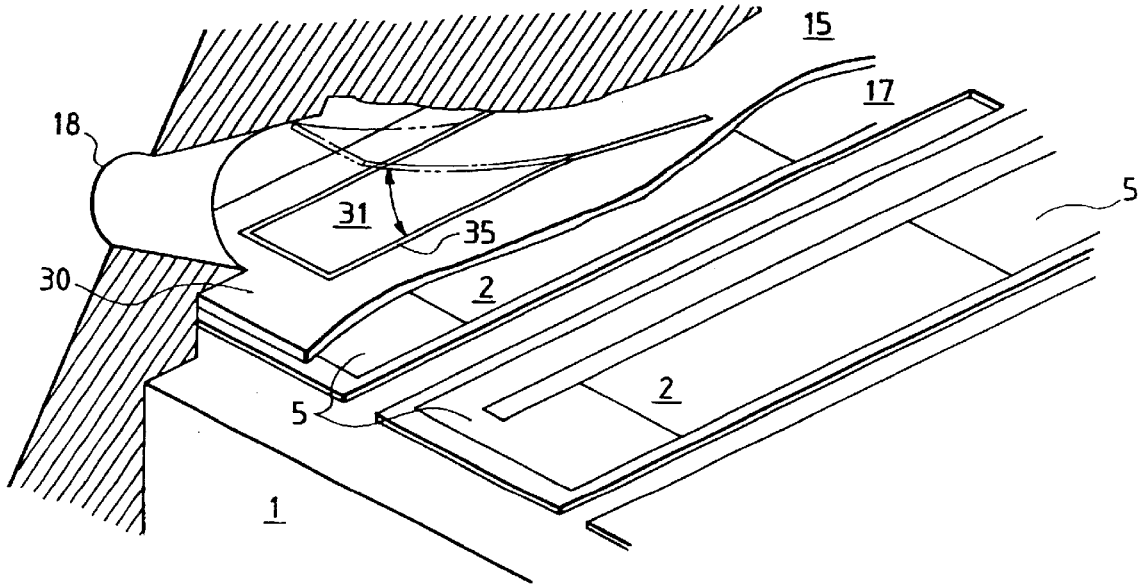
FIG. 7 is a perspective view, partly broken, of the liquid ejecting head shown in FIG. 6.

FIG. 6 is a schematic, cross-sectional view of such a liquid ejecting head, taken along the direction of the liquid flow path, and FIG. 7 is a perspective view, partly broken, of the liquid ejecting head.

The liquid ejecting head has second liquid flow paths 16 for generation of bubble above the element substrate 1 in which heat generating elements 2 for supplying thermal energy for generating the bubble in the liquid are provided, and first liquid flow paths 14 for ejection liquid in direct communication with associated ejection outlets 18 above the second liquid flow paths. The upstream side of the first liquid flow paths is in communication with first common liquid chamber 15 for supplying the ejection liquid to the plural first liquid flow paths and the upstream side of the second liquid flow paths is in communication with second common liquid chamber for supplying the bubble generation liquid to the plural second liquid flow paths.

However, if the bubble generation liquid and the ejection liquid are a same liquid, one common liquid chamber can be shared.

Partition wall 30 made of a material having elasticity, such as metal, is disposed between the first and second liquid flow paths, thereby separating the first liquid flow paths from the second liquid flow paths. In the case of the bubble generation liquid and the ejection liquid being liquids that are preferably kept from mixing with each other as much as possible, it is better to avoid mutual communication of the liquids in the first liquid flow paths 14 and in the second liquid flow paths 16 as completely as possible by the partition wall; in the case of the bubble generation liquid and the ejection liquid being liquids that raise no problem even with some mixture thereof, the partition wall does not have to be provided with the function of complete separation.

The partition wall in the portion located in the upward projection space of the surface of heat generating element 2 (which will be referred to as an ejection pressure generating region; the region of A and the bubble generation region 11 of B in FIG. 6) constitutes the movable member 31 of a cantilever shape defined by slit 35 and having the free end on the ejection outlet side (on the downstream side of the flow of liquid) and the fulcrum 33 on the common liquid chamber (15, 17) side. Since this movable member 31 is positioned so as to face the bubble generation region 11(B), it operates to open toward the ejection outlet on the first liquid flow path side with generation of bubble in the bubble generation liquid (as indicated by the arrow in the figure). Also in FIG. 7, the partition wall 30 is located, with intervention of the spaces constituting the second liquid flow paths, above the element substrate 1 in which heating resistor portions as heat generating elements 2 and wiring electrodes 5 for applying an electric signal to the heating resistor portions are provided.

The relation between the locations of the fulcrum 33 and the free end 32 of the movable member 31 and the location of the heat generating element is the same as in the previous example of the head.

Further, the structural relation between the liquid supply passage 12 and the heat generating element 2 was described in the previous example of the head, and the present example of the head is also arranged so that the structural relation between the second liquid flow path 16 and the heat generating element 2 is the same.

The operation of the liquid ejecting head will be described with reference to FIGS. 8A and 8B.

For driving the head, it was operated using identical water-based ink as the ejection liquid to be supplied to the first liquid flow paths 14 and as the bubble generation liquid to be supplied to the second liquid flow paths 16.

Heat generated by the heat generating element 2 acts on the bubble generation liquid in the bubble generation region of the second liquid flow path, whereby bubble 40 is generated in the bubble generation liquid in the same way as described in the previous embodiment, based on the film boiling phenomenon as described in U.S. Pat. No. 4,723,129.

Figure 8A:
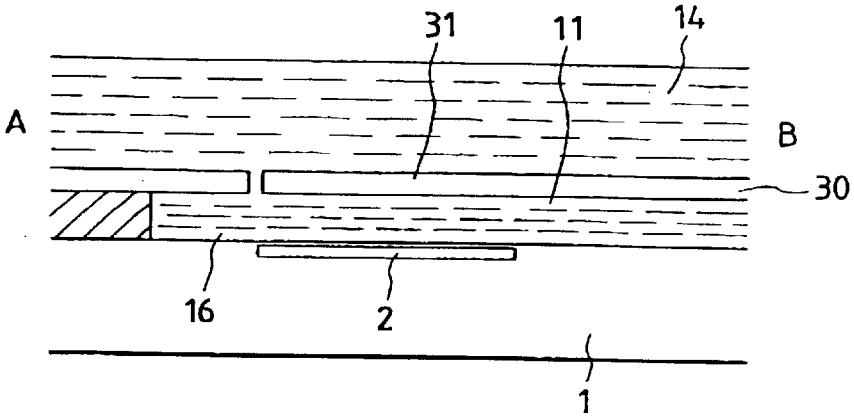
FIG. 8A and FIG. 8B are drawings for explaining the operation of the movable member in the novel liquid ejecting head to which the present invention is applied.
Figure 8B:
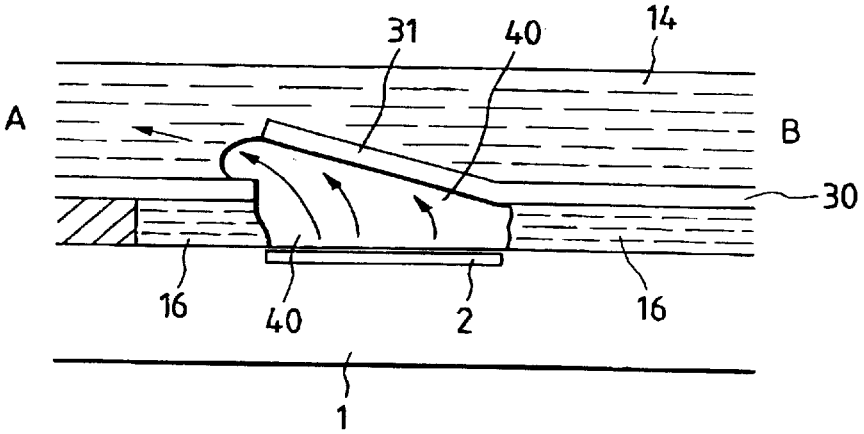

Since the head is arranged to prevent the bubble generation pressure from escaping in the three directions except toward the upstream side of the bubble generation region, the pressure with generation of this bubble propagates as concentrated on the movable member 31 located in the ejection pressure generating region, so that with growth of bubble the movable member 31 is displaced into the first liquid flow path side from the state of FIG. 8A to FIG. 8B. This operation of the movable member 31 makes the first liquid flow path 14 go into wide communication with the second liquid flow path 16, whereby the pressure based on the generation of bubble is transferred mainly in the direction toward the ejection outlet (toward A). This propagation of pressure and the aforementioned mechanical displacement of the movable member cause the liquid to be ejected through the ejection outlet.

Next, with contraction of the bubble the movable member 31 returns to the position of FIG. 8A and the ejection liquid is supplied from upstream by an amount equivalent to an ejected amount of the ejection liquid in the first liquid flow path 14. Also in the present embodiment, since this supply of the ejection liquid is effected with the movable member closing in the same manner as in the foregoing embodiments, the refilling of the ejection liquid is not impeded by the movable member.

The head of the present embodiment achieves the same actions and effects of the main components as to the propagation of the bubble generation pressure with displacement of the movable member, the growing directions of bubble, the prevention of the back wave, and so on as the foregoing first example etc. did, but the present embodiment further has the following advantages because of the two-flow-path structure thereof.

Specifically, the above-stated head structure of the above-stated example permits different liquids to be used as the ejection liquid and as the bubble generation liquid, whereby the ejection liquid can be ejected by the pressure caused by the generation of bubble in the bubble generation liquid. Therefore, even a high-viscosity liquid, for example, polyethylene glycol that was insufficient in generation of bubble with application of heat and insufficient in ejection force heretofore, can be ejected well by supplying a well-bubbling liquid (a mixture of ethanol:water=4:6 having the viscosity of 1 to 2 cP or the like) or a low-boiling-point liquid as the bubble generation liquid to the second liquid flow path 16.

When a liquid not forming the deposits of scorching or the like on the surface of the heat generating element with reception of heat is selected as the bubble generation liquid, the generation of bubble can be stabilized and good ejection can be achieved.

Further, the structure of the head of the present example also has the effects as described in the previous example of the head, whereby the liquid such as the high-viscosity liquid can be ejected at higher ejection efficiency and higher ejection force.

Even in the case of a liquid weak against heat, the liquid weak against heat can be ejected without thermal damage and at high ejection efficiency and high ejection force as described above, by supplying the liquid weak against heat as the ejection liquid to the first liquid flow path and supplying a well-bubbling liquid resistant against thermal modification to the second liquid flow path.

Since the head in the structure described above also has the high ejection efficiency, the energy amount received by the head from the device side can be made smaller than those of the conventional heads.

Even if the head achieving the energy saving in this way was attempted to be mounted on a device, which had incorporated the conventional head, it was not easy to mount the head on the device, because the supply amount of electric energy from the device side was different from the electric energy amount received by the head.

Described below are a liquid ejecting device, a liquid ejecting head, and so on according to the present invention, which are improved in this respect.

Since the liquid ejecting head as described above has the high ejection efficiency, it can perform recording by ejecting the liquid by a lower driving voltage or by a shorter voltage application time than the conventional heads. In order to secure compatibility with the conventional products so as to allow the ejecting head cartridge equipped with the ejecting head with such excellent characteristics to be also used in the conventional recording devices, the driving method and the voltage for ink ejection supplied need to be matched with the new ejecting head cartridge.

In the driving system of the present invention, converting means of driving signal or driving voltage (means for converting the electric energy) is mounted in the ejecting head or in the head cartridge in which the ejecting head and an ink container are incorporated. This permits the ejecting head of the present invention to be used as replacing the conventional ejecting heads.

Figure 20A:
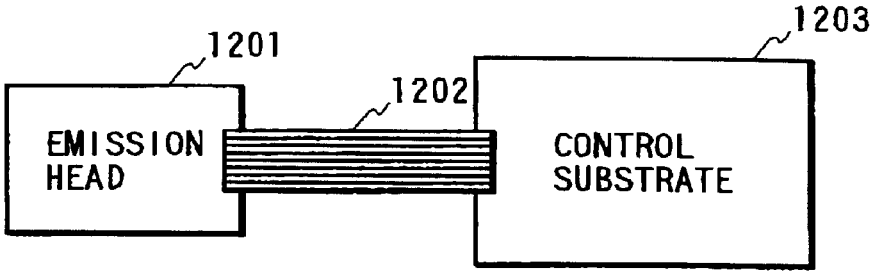
FIG. 20A and FIG. 20B are drawings to show an example of driving system.
Figure 20B:
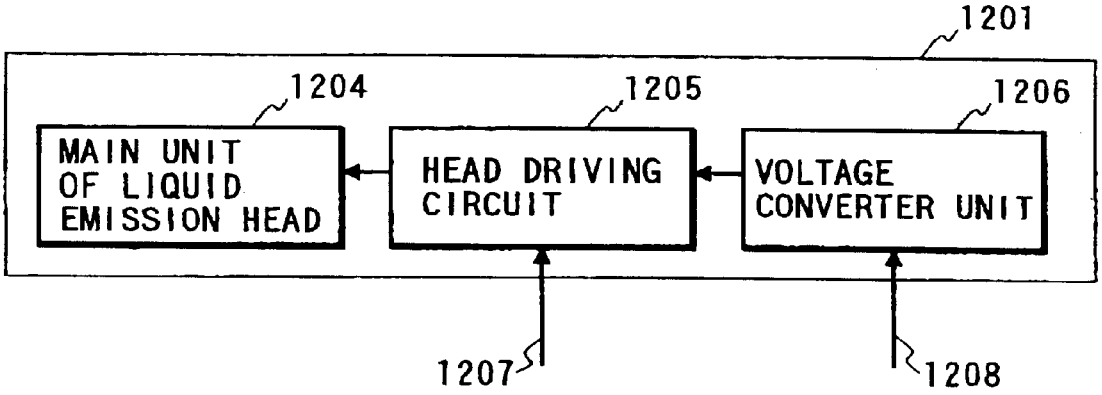

FIGS. 20A and 20B are structural drawings for explaining an embodiment of the driving system according to the present invention. As shown in FIG. 20A, ejecting head 1201 and control board 1203 are connected with each other by flexible cable 1202. The ejecting head 1201 and control board 1203 correspond to head 200 and head driver 307, respectively, in the drawing described hereinafter. Recording signal 1207 and driving voltage 1208 shown in FIG. 20B are supplied from the control board 1203 to the ejecting head 1201 through the flexible cable 1202. Although other various control signals are supplied from the control board 1203 to the ejecting head 1201 and reply signals etc. are also supplies from the ejecting head 1201 to the control board 1203 in addition to the above signals, they are not illustrated, because they are irrelevant to the present embodiment.

The ejecting head 1201 is composed of main unit of liquid ejecting head 1204, head driving circuit 1205, and voltage converter unit 1206 as shown in FIG. 20B. The main unit of liquid ejecting head 1204 has the structure of the liquid ejecting head, for example, as described above. The voltage converter unit 1206 is provided so as to meet the characteristic of high ejection efficiency of the liquid ejecting head 1204 described in each embodiment and converts the driving voltage 1208 to a suitable voltage for driving the main unit of liquid ejecting head 1204 to output the suitable voltage to the head driving circuit 1205. The head driving circuit 1205 receives the recording signal 1207 and applies the optimum driving voltage supplied from the voltage converter unit 1206 to the heat generating elements provided in nozzles expected to eject the liquid out of a plurality of nozzles constituting the liquid ejecting head, as indicated by the recording signal 1207.

Since the liquid ejecting head 1201 in the present embodiment has the high ejection efficiency, it is set to be driven by a lower driving voltage than the conventional liquid ejecting heads were. Since the driving voltage supplied from the recording apparatus ready for the conventional liquid ejecting heads is thus higher than the driving voltage suitable for the liquid ejecting head 1201, the voltage converter unit 1206 performs such conversion of voltage as to lower the driving voltage 1208 supplied from the apparatus, to the driving voltage suitable for the liquid ejecting head 1201.

Specific examples of methods for performing the voltage conversion operation in the voltage converter unit 1206 include a method with a voltage divider using a resistor, a method with a DC-DC converter, and so on. The present invention may adopt either one of the methods, and can also adopt other techniques of voltage conversion operation.

In general, if the voltage converter unit receives supply of a voltage below a voltage after conversion set in the voltage converter unit or if it receives supply of a voltage below voltages in the range permitted by I/O potential difference of the voltage converter unit, the voltage converter unit outputs the same voltage as the input voltage. With the structure of the liquid ejecting head provided with the voltage converter unit 1206 as shown in FIG. 20B, therefore, the head can be driven by decreasing the driving voltage supplied thereto to the driving voltage suitable for the liquid ejecting head when the head is mounted on the recording apparatus ready for the conventional liquid ejecting heads; and the liquid ejecting head 1201 can also be driven properly when it is mounted on the recording apparatus ready for the novel liquid ejecting head.

The characteristic structure of the present invention shown in FIGS. 20A and 20B enables to use the novel liquid ejecting head employing the liquid ejecting method with increased ejection efficiency, in the recording apparatus ready for the conventional liquid ejecting heads. Since the structure of the present invention is arranged to convert the driving voltage supplied from the recording apparatus, inside the liquid ejecting head without increase of power supply system of the recording apparatus itself, it becomes possible to provide the performance of the novel liquid ejecting head for users of the recording apparatus designed on the premise of use of the conventional liquid ejecting heads.

The structure of the present invention requires no improvement of the recording apparatus itself, does not increase the cost, and does not increase the size of the recording apparatus, when compared with the techniques for enabling use of various liquid ejecting heads of different driving voltages by increasing the number of power supply systems of the apparatus itself.

Although the present invention was described with the example of the structure of FIGS. 20A and 20B, the present invention can also be applied to such a structure that the aforementioned voltage converter unit 1206 is provided in a structure of head cartridge form in which an ink container (ink tank) for reserving ink is integrally formed with the liquid ejecting head 1201.

It becomes possible to make the consumption power lower by use of the method with good voltage conversion efficiency such as the DC-DC converter among the various techniques of voltage conversion operation described above. In the case of use of the voltage divider, the consumption power is the same as in the conventional products and the load, when seen from the control board 1203 side, is the same as in the conventional products, which stabilizes the operation of the circuit for outputting the driving voltage 1208.

For making the liquid ejecting head with high ejection efficiency as in the present embodiment capable of replacing the conventional products, there is a method for shortening the voltage application time in addition to the method for decreasing the driving voltage as described above. The recording signal 1207 sent from the control board 1203 to the head driving circuit 1205 of the ejecting head cartridge 1201 is a pulse signal for designating nozzles to be activated for ejection and for determining on times of the respective heat generating elements provided in the nozzles to be activated for ejection, and the width of the pulse signal may be arranged to differ depending upon the type of liquid ejecting head, which enables the head to be used as replacing the conventional products in the same manner as described above.

In the case of the width (voltage application time) of the pulse signal being changed as described above, a possible arrangement is such that the ejecting head cartridge is provided with a function to output an ID signal indicating the type of the liquid ejecting head mounted and the control board 1203 side (recording apparatus side) is provided with controlling means for identifying the type of liquid ejecting head from presence or absence of the ID signal and output contents thereof and for controlling the width of pulse signal according to the type thus identified.

Among the driving systems described above, the driving system for controlling the driving voltage on the liquid ejecting head side enables the head to replace the conventional products as a matter of course, and can be used in the recording apparatus having been used heretofore.

The method for controlling the width of pulse signal necessitates the means for adjusting the width of pulse signal by discriminating the ID signals, but the control is conducted by only adjustment of electric signal, which can realize both increase in the efficiency of power consumption and enhancement of operation stability of the circuit for outputting the driving voltage 1208.

For enabling the liquid ejecting head with high ejection efficiency to replace the conventional products as in the present embodiment, it is also possible to employ a method for decreasing the area of heat generating element for generating the bubble, in addition to the method for converting the driving voltage and the method for decreasing the voltage application time as described above.

Specifically, the ejecting head of the present invention wherein the movable members are opposed to the heat generating elements can achieve the same ejection performance even under lower pressure of bubble, as compared with the heat generating elements of the conventional liquid ejecting heads. Accordingly, the area of heat generating element for achieving the same ejection characteristics can be smaller than the conventionally required area.

One of this technique can be achieved by adjusting the width of heat generating element 2 with respect to the flow direction of current therein, as shown in FIG. 7, for example.

In this case, since the length of heat generating element is not changed in the flow direction of current, the density of current flowing in the heat generating element is kept identical, so that the head can be driven under appropriate conditions by the same voltage while lowering the applied energy.

On the other hand, if the area of heat generating element is decreased by shortening the length in the flow direction of current, the resistance should be increased by decreasing the thickness of the resistor layer of heat generating element 2 between the electrodes 5, so as to maintain constant heat quantity per unit area of heat generating element, whereby the head can be driven under proper conditions by the same voltage while lowering the applied energy.

In the case of the method for decreasing the area of heat generating element described above, adjustment is necessary in an initial step in the process for fabricating the head, and thus studies on design become necessary; but it is advantageous in respect of the cost because it requires no circuit for converting the voltage or the like.

Other Embodiments

In the foregoing, the description has been made as to the embodiments of the major parts of the liquid ejecting head and the liquid ejecting method according to the present invention, and specific examples preferably applicable to these embodiments will be explained with reference to the drawings. Although each of the following examples will be explained as either an embodiment of the single-flow-path type or an embodiment of the two-flow-path type described previously, it should be noted that they can be applied to the both types unless otherwise stated.

<Ceiling Configuration of Liquid Flow Path>

Figure 9:
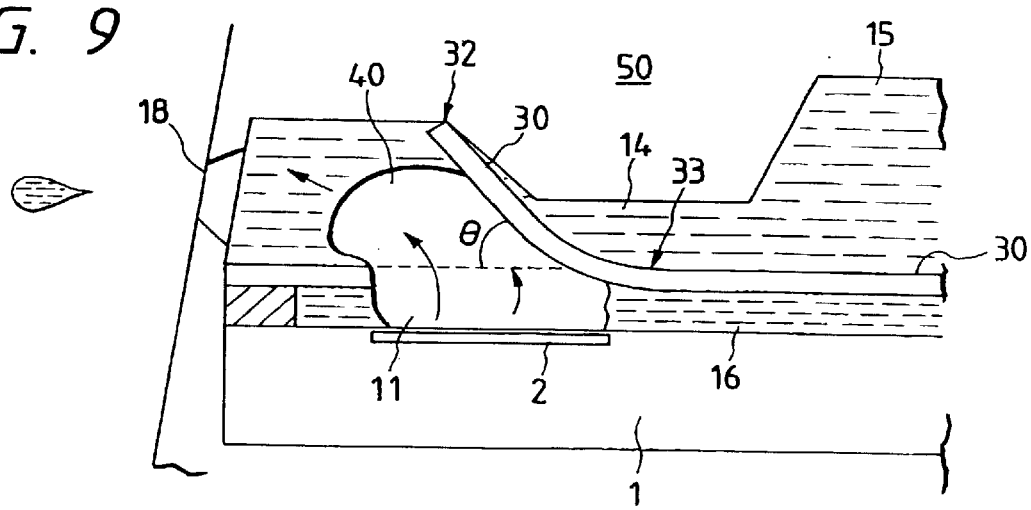
FIG. 9 is a drawing for explaining the structure of the movable member and the first liquid flow path in the novel liquid ejecting head to which the present invention is applied.

FIG. 9 is a cross-sectional view along the flow path direction of the liquid ejecting head of the present invention, wherein a grooved member 50 provided with grooves for constituting the first liquid flow paths 13 (or the liquid flow paths 10 in FIGS. 1A to 1D) is provided on a partition wall 30. In the present embodiment, the height of the flow path ceiling near the position of the free end 32 of the movable member is increased so as to secure a greater operation angle θ of the movable member. The moving range of this movable member may be determined in consideration of the structure of the liquid flow path, the durability of the movable member, and the bubble generating power, or the like, and the movable member is considered to desirably move up to an angle including an axial angle of the ejection outlet.

As shown in this figure, the height of displacement of the free end of the movable member is made higher than the diameter of the ejection outlet, whereby transmission of more sufficient ejection force can be achieved. Since the height of the ceiling of the liquid flow path at the position of fulcrum 33 of the movable member is lower than the height of the ceiling of liquid flow path at the position of the free end 32 of the movable member as shown in this figure, the pressure wave can be prevented more effectively from escaping to the upstream side with displacement of the movable member.

<Positional Relation Between Second Liquid Flow Path and Movable Member>

Figure 10A:
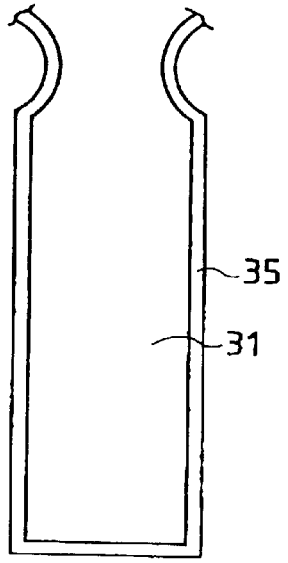
FIGS. 10A, 10B and 10C are drawings for explaining the structure of the movable member and the liquid flow path in the novel liquid ejecting head to which the present invention is applied.
Figure 10B:
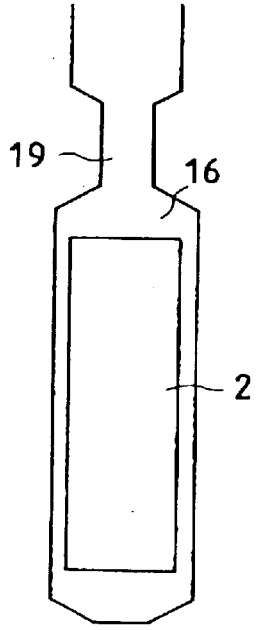
Figure 10C:
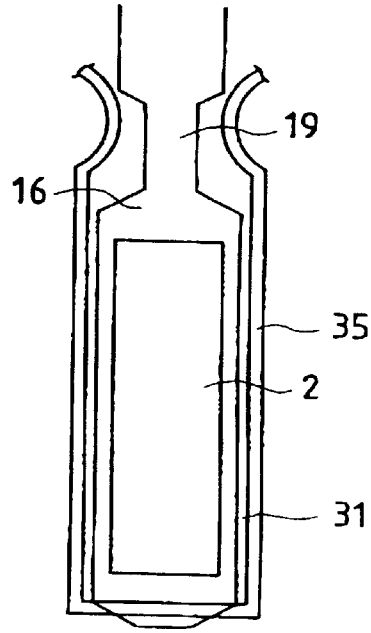

FIGS. 10A to 10C are drawings for explaining the positional relation between the movable member 31 and the second liquid flow path 16 described above, wherein FIG. 10A is a top plan view of the partition wall 30, the movable member 31, and their neighborings, FIG. 10B a top plan view of the second liquid flow path 16 when the partition wall 30 is taken away, and FIG. 10C a drawing to schematically show the positional relation between the movable member 31 and the second liquid flow path 16 as overlaid. In either drawing, the bottom side is the front side where the ejection outlet is positioned.

The second liquid flow path 16 of the present embodiment has throat portion 19 on the upstream side of the heat generating element 2 (the upstream side herein means the upstream side in the large flow from the second common liquid chamber via the position of the heat generating element, the movable member, and the first flow path to the ejection outlet), thereby forming such a chamber (bubble generation chamber) structure that the pressure upon generation of bubble can be prevented from readily escaping to the upstream side of the second liquid flow path 16.

In the case of the conventional head wherein the flow path for the bubble generation and the flow path for ejection of the liquid were common, when a throat portion was provided so as to prevent the pressure occurring on the liquid chamber side of the heat generating element from escaping into the common liquid chamber, the head was needed to employ such a structure as the cross-sectional area of flow path in the throat portion was not too small, taking sufficient refilling of the liquid into consideration.

However, in the case of this embodiment, much or most of the ejected liquid is the ejection liquid in the first liquid flow path, and the bubble generation liquid in the second liquid flow path having the heat generating element is not consumed much, so that the filling amount of the bubble generation liquid to the bubble generation region 11 of the second liquid flow path may be small. Therefore, the clearance at the above-stated throat portion 19 can be made very small, for example, as small as several μm to ten and several μm, so that the release of the pressure produced in the second liquid flow path upon generation of bubble can be further suppressed and the pressure may be concentrated onto the movable member. The pressure can thus be used as the ejection force through the movable member 31, and therefore, the higher ejection efficiency and ejection force can be accomplished. The configuration of the second liquid flow path 16 is not limited to the one described above, but may be any configuration if the pressure produced by the bubble generation is effectively transmitted to the movable member side.

As shown in FIG. 10C, the sides of the movable member 31 cover respective parts of the walls constituting the second liquid flow path, which can prevent the movable member 31 from falling into the second liquid flow path. This can further enhance the separation between the ejection liquid and the bubble generation liquid described previously. In addition, this arrangement can suppress escape of the bubble through the slit, thereby further increasing the ejection pressure and ejection efficiency. Further, it can enhance the aforementioned refilling effect from the upstream side by the pressure upon collapse of bubble.

In FIG. 8B and FIG. 9, a part of the bubble generated in the bubble generation region of the second liquid flow path 16 with displacement of the movable member 31 into the first liquid flow path 14 extends in the first liquid flow path 14, and by determining the height of the second liquid flow path so as to permit the bubble to extend in this way, the ejection force can be improved furthermore than in the case of the bubble not extending in such a way. In order to permit the bubble to extend in the first liquid flow path 14 as described, the height of the second liquid flow path 16 is determined to be preferably lower than the height of the maximum bubble and, specifically, the height of the second liquid flow path 16 is determined preferably in the range of several μm to 30 μm. In the present embodiment this height is 15 μm.

<Movable Member and Partition Wall>

Figure 11A:
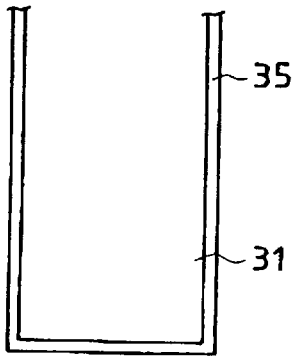
FIGS. 11A, 11B and 11C are drawings for explaining other shapes of the movable member of the novel ejecting head.
Figure 11B:
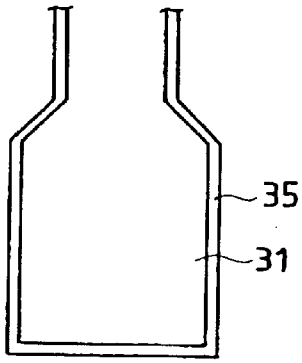
Figure 11C:
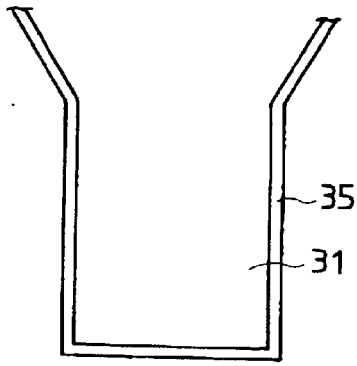

FIGS. 11A, 11B, and 11C are drawings to show other configurations of the movable member 31, wherein reference numeral 35 designates the slit formed in the partition wall and this slit forms the movable member 31. FIG. 11A is a drawing to illustrate a rectangular configuration, FIG. 11B a drawing to illustrate a configuration narrowed on the fulcrum side to facilitate the operation of the movable member, and FIG. 11C a drawing to illustrate a configuration widened on the fulcrum side to enhance the durability of the movable member. A shape with ease to operate and high durability is desirably a configuration the fulcrum-side width of which is narrowed in an arcuate shape as shown in FIG. 10A, but the configuration of the movable member may be any configuration if it is kept from entering the second liquid flow path and if it is readily operable and excellent in the durability.

In the foregoing embodiment, the plate movable member 31 and the partition wall 30 having this movable member were made of nickel in the thickness of 5 μm, but, without having to be limited to this, the materials for the movable member and the partition wall may be selected from those having an anti-solvent property against the bubble generation liquid and the ejection liquid, having elasticity for assuring the satisfactory operation of the movable member, and permitting formation of fine slit.

Preferable examples of the material for the movable member include durable materials, for example, metals such as silver, nickel, gold, iron, titanium, aluminum, platinum, tantalum, stainless steel, or phosphor bronze, alloys thereof, resin materials, for example, those having the nitryl group such as acrylonitrile, butadiene, or styrene, those having the amide group such as polyamide, those having the carboxyl group such as polycarbonate, those having the aldehyde group such as polyacetal, those having the sulfone group such as polysulfone, those such as liquid crystal polymers, and chemical compounds thereof; and materials having durability against ink, for example, metals such as gold, tungsten, tantalum, nickel, stainless steel, titanium, alloys thereof, materials coated with such a metal, resin materials having the amide group such as polyamide, resin materials having the aldehyde group such as polyacetal, resin materials having the ketone group such as polyetheretherketone, resin materials having the imide group such as polyimide, resin materials having the hydroxyl group such as phenolic resins, resin materials having the ethyl group such as polyethylene, resin materials having the alkyl group such as polypropylene, resin materials having the epoxy group such as epoxy resins, resin materials having the amino group such as melamine resins, resin materials having the methylol group such as xylene resins, chemical compounds thereof, ceramic materials such as silicon dioxide, and chemical compounds thereof.

Preferable examples of the material for the partition wall include resin materials having high heat-resistance, a high anti-solvent property, and good moldability, typified by recent engineering plastics, such as polyethylene, polypropylene, polyamide, polyethylene terephthalate, melamine resins, phenolic resins, epoxy resins, polybutadiene, polyurethane, polyetheretherketone, polyether sulfone, polyallylate, polyimide, polysulfone, liquid crystal polymers (LCPs), chemical compounds thereof, silicon dioxide, silicon nitride, metals such as nickel, gold, or stainless steel, alloys thereof, chemical compounds thereof, or materials coated with titanium or gold.

The thickness of the partition wall may be determined depending upon the material and configuration from such standpoints as to achieve the strength as a partition wall and to well operate as a movable member, and a desirable range thereof is approximately between 0.5 μm and 10 μm.

The width of the slit 35 for forming the movable member 31 is determined to be 2 μm in the present embodiment. In the cases where the bubble generation liquid and the ejection liquid are mutually different liquids and mixture is desirably prevented between the two liquids, the slit width may be determined to be such a clearance as to form a meniscus between the two liquids so as to avoid communication between the two liquids. For example, when the bubble generation liquid is a liquid having the viscosity of about 2 cP (centipoises) and the ejection liquid is a liquid having the viscosity of 100 or more cP, a slit of approximately 5 μm is enough to prevent the mixture of the liquids, but a desirable slit is 3 or less μm.

<Element Substrate>

Next explained is the structure of the element substrate in which the heat generating elements for supplying heat to the liquid are mounted.

Figure 12A:
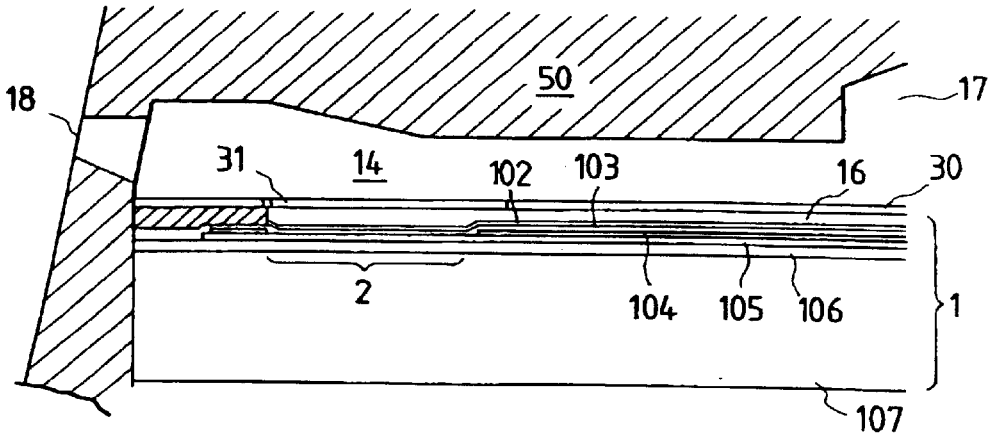
FIG. 12A and FIG. 12B are longitudinal, cross-sectional views of novel liquid ejecting heads to which the present invention is applied.
Figure 12B:
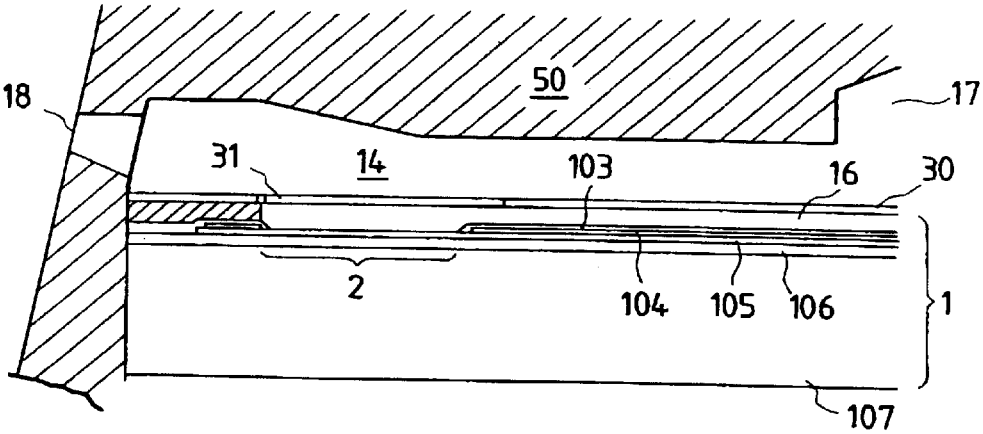

FIGS. 12A and 12B show longitudinal, sectional views of liquid ejecting heads according to the present invention, wherein FIG. 12A is a drawing to show the head with a protecting film as detailed hereinafter and FIG. 12B a drawing to show the head without a protecting film.

Above the element substrate 1 there are provided second liquid flow paths 16, partition wall 30, first liquid flow paths 14, and grooved member 50 having grooves for forming the first liquid flow paths.

The element substrate 1 has patterned wiring electrodes (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating elements on silicon oxide film or silicon nitride film 106 for electric insulation and thermal accumulation formed on the substrate 107 of silicon or the like, as shown in FIG. 7. The resistance layer generates heat when a voltage is applied to the resistance layer 105 through the two wiring electrodes 104 so as to let an electric current flow in the resistance layer. A protecting layer of silicon dioxide, silicon nitride, or the like 0.1–2.0 μm thick is provided on the resistance layer between the wiring electrodes, and in addition, an anti-cavitation layer of tantalum or the like (0.1–0.6 μm thick) is formed thereon to protect the resistance layer 105 from various liquids such as ink.

Particularly, the pressure and shock wave generated upon generation or collapse of bubble is so strong that the durability of the oxide film being hard and relatively fragile is considerably deteriorated. Therefore, a metal material such as tantalum (Ta) or the like is used as a material for the anti-cavitation layer.

The protecting layer stated above may be omitted depending upon the combination of liquid, liquid flow path structure, and resistance material, an example of which is shown in FIG. 12B. The material for the resistance layer not requiring the protecting layer may be, for example, an iridium-tantalum-aluminum alloy or the like.

Thus, the structure of the heat generating element in each of the foregoing embodiments may include only the resistance layer (heat generating portion) between the electrodes as described, or may also include the protecting layer for protecting the resistance layer.

In this embodiment, the heat generating element has a heat generation portion having the resistance layer which generates heat in response to an electric signal. Without having to be limited to this, any means may be employed if it creates a bubble enough to eject the ejection liquid, in the bubble generation liquid. For example, the heat generating element may be one having such a heat generation portion as a photothermal transducer which generates heat upon receiving light such as laser or as a heat generation portion which generates heat upon receiving high frequency wave.

Functional elements such as a transistor, a diode, a latch, a shift register, and so on for selectively driving the electrothermal transducers may also be integrally built in the aforementioned element substrate 1 by the semiconductor fabrication process, in addition to the electrothermal transducers comprised of the resistance layer 105 for constituting the heat generating elements and the wiring electrodes 104 for supplying the electric signal to the resistance layer.

Figure 13:
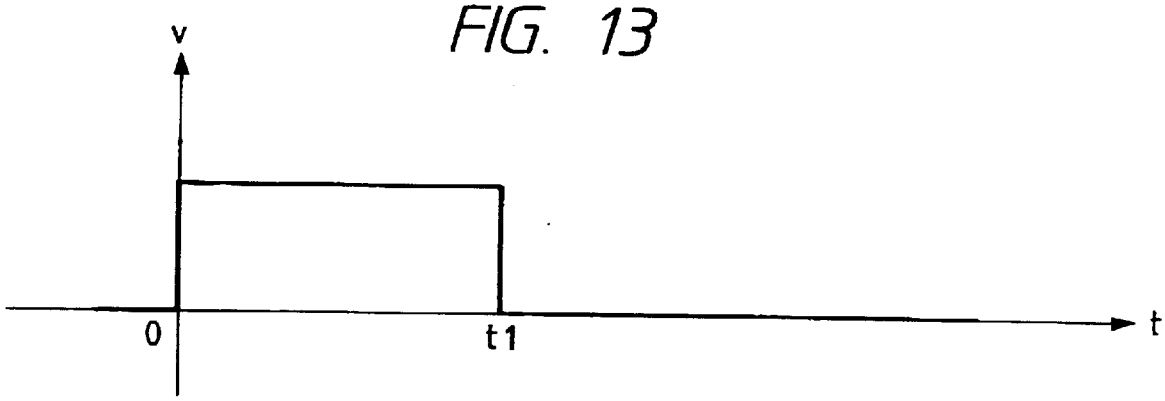
FIG. 13 is a schematic diagram to show a waveform of a driving pulse in the novel liquid ejecting head.

In order to drive the heat generation portion of each electrothermal transducer on the above-described element substrate 1 so as to eject the liquid, a rectangular pulse as shown in FIG. 13 is applied through the wiring electrodes 104 to the aforementioned resistance layer 105 to quickly heat the resistance layer 105 between the wiring electrodes. With the heads of the foregoing embodiments, the electric signal was applied to the layer at the voltage 24V, the pulse width 7 $\mu$sec, the electric current 150 mA, and the frequency 6 kHz to drive each heat generating element, whereby the ink as a liquid was ejected through the ejection outlet, based on the operation described above. However, the conditions of the driving signal are not limited to the above, but any driving signal may be used if it can properly generate a bubble in the bubble generation liquid.

<Head Structure Consisting of Two Flow Paths>

Described in the following is a structural example of the liquid ejecting head that is arranged as capable of separately introducing different liquids to the first and second common liquid chambers and that allows reduction in the number of parts and in the cost.

Figure 14:
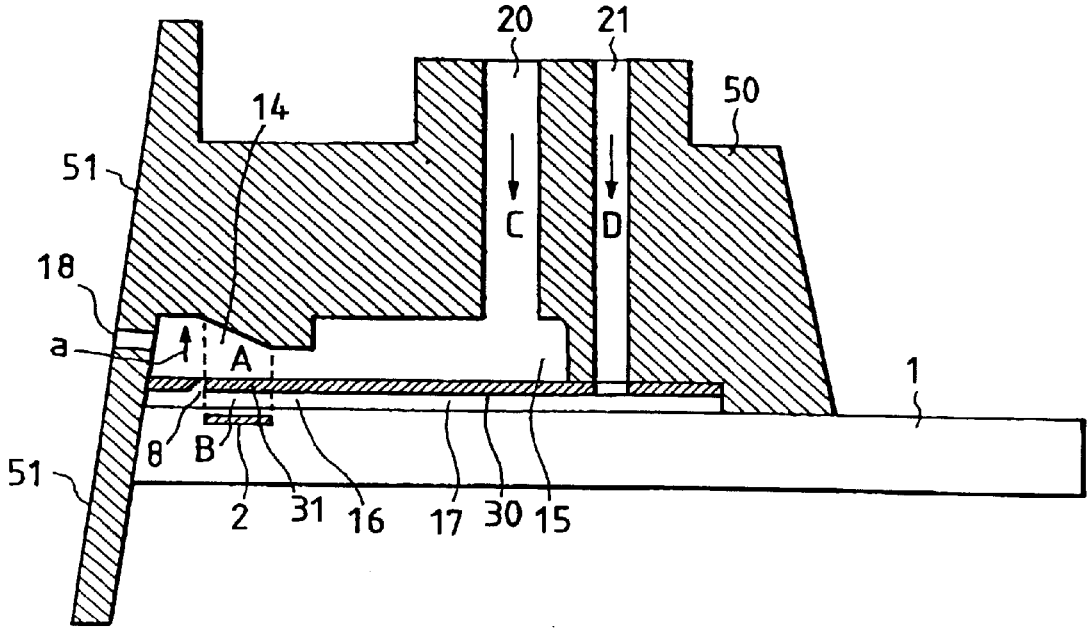
FIG. 14 is a cross-sectional view for explaining supply passages in the novel liquid ejecting head to which the present invention is applied.

FIG. 14 is a schematic view to show the structure of such a liquid ejecting head, wherein the same reference numerals denote the same constituent elements as in the previous embodiments, and the detailed description thereof will be omitted herein.

In the present embodiment, the grooved member 50 is composed mainly of orifice plate 51 having ejection outlets 18, a plurality of grooves for forming a plurality of first liquid flow paths 14, and a recess portion for forming a first common liquid chamber 15, in communication with a plurality of liquid flow paths 14, for supplying the liquid (ejection liquid) to each first liquid flow path 14.

The plurality of first liquid flow paths 14 can be formed by joining the partition wall 30 to the bottom part of this grooved member 50. This grooved member 50 has first liquid supply passage 20 running from the top part thereof into the first common liquid chamber 15. The grooved member 50 also has second liquid supply passage 21 running from the top part thereof through the partition wall 30 into the second common liquid chamber 17.

The first liquid (ejection liquid) is supplied, as shown by arrow C of FIG. 14, through the first liquid supply passage 20 and through the first common liquid chamber 15 then to the first liquid flow paths 14, while the second liquid (bubble generation liquid) is supplied, as shown by arrow D of FIG. 14, through the second liquid supply passage 21 and through the second common liquid chamber 17 then to the second liquid flow paths 16.

The present embodiment is arranged to have the second liquid supply passage 21 disposed in parallel to the first liquid supply passage 20, but, without having to be limited to this, the second liquid supply passage 21 may be positioned at any position as long as it is formed so as to pierce the partition wall 30 outside the first common liquid chamber 15 and to communicate with the second common liquid chamber 17.

The size (the diameter) of the second liquid supply passage 21 is determined in consideration of the supply amount of the second liquid. The shape of the second liquid supply passage 21 does not have to be circular, but may be rectangular or the like.

Figure 15:
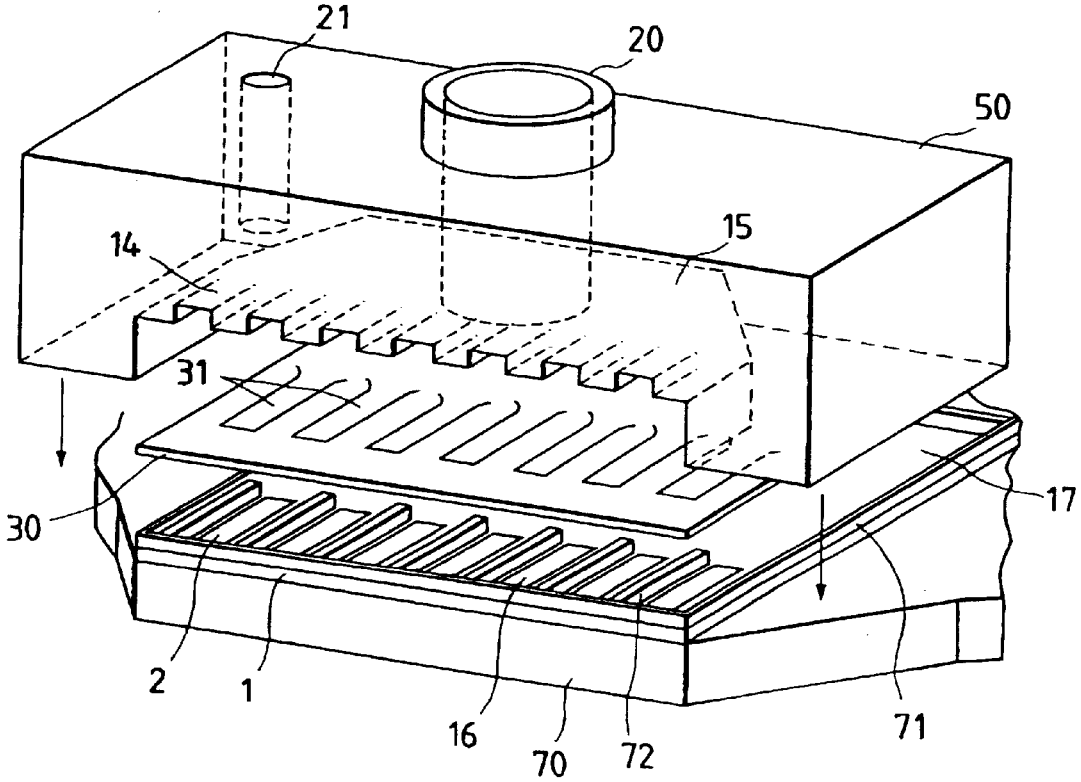
FIG. 15 is an exploded, perspective view of a novel liquid ejecting head to which the present invention is applied.

The second common liquid chamber 17 can be formed by partitioning the grooved member 50 by the partition wall 30. A method for forming the structure is as follows. As shown in the exploded, perspective view of the present embodiment shown in FIG. 15, a frame of the common liquid chamber and walls of the second liquid flow paths are made of a dry film on an element substrate and a combination of the partition wall 30 with the grooved member 50 fixed with each other is bonded to the element substrate 1, thereby forming the second common liquid chamber 17 and the second liquid flow paths 16.

In the present embodiment the substrate element 1 is placed on a support member 70 made of metal such as aluminum and the element substrate 1 is provided with electrothermal transducers as heat generating elements for generating heat for producing a bubble by film boiling in the bubble generation liquid, as described previously.

On this element substrate 1 there are provided a plurality of grooves for forming the liquid flow paths 16 constructed of the second liquid path walls, a recess portion for forming the second common liquid chamber (common bubble generation liquid chamber) 17, arranged in communication with the plurality of bubble generation liquid flow paths, for supplying the bubble generation liquid to each bubble generation liquid path, and the partition wall 30 provided with the movable walls 31 described previously.

Reference numeral 50 designates the grooved member. This grooved member has the grooves for forming the ejection liquid flow paths (first liquid flow paths) 14 by joining the grooved member with the partition wall 30, the recess portion for forming the first common liquid chamber (common ejection liquid chamber) 15 for supplying the ejection liquid to each ejection liquid flow path, the first supply passage (ejection liquid supply passage) 20 for supplying the ejection liquid to the first common liquid chamber, and the second supply passage (bubble generation liquid supply passage) 21 for supplying the bubble generation liquid to the second common liquid chamber 17. The second supply passage 21 is connected to a communication passage running through the partition wall 30 located outside the first common liquid chamber 15 and being in communication with the second common liquid chamber 17, whereby the bubble generation liquid can be supplied to the second common liquid chamber 15 through this communication passage without mixing with the ejection liquid.

The positional relation among the element substrate 1, the partition wall 30, and the grooved top plate 50 is such that the movable members 31 are positioned corresponding to the heat generating elements of the element substrate 1 and the ejection liquid flow paths 14 are positioned corresponding to the movable members 31. The present embodiment showed the example wherein one second supply passage was formed in the grooved member, but a plurality of second supply passages may be provided depending upon the supply amount. Further, cross-sectional areas of flow path of the ejection liquid supply passage 20 and the bubble generation liquid supply passage 21 may be determined in proportion to the supply amount.

The components constituting the grooved member 50 etc. can be further compactified by optimizing such cross-sectional areas of flow path.

As described above, since the present embodiment is arranged so that the second supply passage for supplying the second liquid to the second liquid flow paths and the first supply passage for supplying the first liquid to the first liquid flow paths are formed in the grooved top plate as a single grooved member, the number of parts can be decreased, whereby the reduction in the manufacturing steps and costs can be achieved.

Since the structure is such that supply of the second liquid to the second common liquid chamber in communication with the second liquid flow paths is achieved through the second supply passage in the direction to penetrate the partition wall for separating the first liquid from the second liquid, the bonding step of the partition wall, the grooved member, and the heat-generating-element-formed substrate can be a single step, which enhances ease to fabricate and the bonding accuracy, thereby permitting good ejection.

Since the second liquid is supplied to the second liquid common liquid chamber through the partition wall, this arrangement assures supply of the second liquid to the second liquid flow paths and also assures the sufficient supply amount, thus permitting stable ejection.

<Ejection Liquid and Bubble Generation Liquid>

Since the present invention employs the structure having the aforementioned movable members as discussed in the previous embodiments, the liquid ejecting heads according to the present invention can eject the liquid under higher ejection force, at higher ejection efficiency, and at higher speed than the conventional liquid ejecting heads can. In the case of the same liquid being used for the bubble generation liquid and the ejection liquid in the present embodiment, the liquid may be selected from various liquids that are unlikely to be deteriorated by the heat applied by the heat generating element, that are unlikely to form the deposits on the heat generating element with application of heat, that are capable of undergoing reversible state changes between gasification and condensation with application of heat, and that are unlikely to deteriorate the liquid flow paths, the movable member, the partition wall, and so on.

Among such liquids, the liquid used for recording (recording liquid) may be one of the ink liquids of compositions used in the conventional bubble jet devices.

On the other hand, when the two-flow-path structure of the present invention is used with the ejection liquid and the bubble generation liquid of different liquids, the bubble generation liquid may be one having the above-mentioned properties; specifically, it may be selected from methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water, and mixtures thereof.

The ejection liquid may be selected from various liquids, regardless of possession of the bubble generation property and thermal property thereof. Further, the ejection liquid may be selected from liquids with a low bubble generation property, ejection of which was difficult by the conventional heads, liquids likely to be modified or deteriorated by heat, and liquids with high viscosity.

However, the ejection liquid is preferably a liquid not to hinder the ejection of liquid, the generation of bubble, the operation of the movable member, and so on because of the ejection liquid itself or because of a reaction thereof with the bubble generation liquid.

For example, high-viscosity ink may be used as the ejection liquid for recording. Other ejection liquids applicable include liquids weak against heat such as pharmaceutical products and perfumes.

In the present invention recording was carried out by use of the ink liquid in the following composition as a recording liquid usable for the both ejection liquid and bubble generation liquid. Since the ejection speed of ink was increased by an improvement in the ejection force, the shot accuracy of liquid droplet was improved, which enabled to obtain very good recording images.

| Dye ink (viscosity 2 cP): | |
|---|---|
| (C. I. food black 2) dye | 3 wt % |
| Diethylene glycol | 10 wt % |
| Thio diglycol | 5 wt % |
| Ethanol | 3 wt % |
| Water | 77 wt % |

Further, recording was also carried out with combinations of liquids in the following compositions for the bubble generation liquid and the ejection liquid. As a result, the head of the present invention was able to well eject not only a liquid with a viscosity of ten and several cP, which was not easy to eject by the conventional heads, but also even a liquid with a very high viscosity of 150 cP, thus obtaining high-quality recorded objects.

| | |
|---|---|
| Bubble generation liquid 1: | |
| Ethanol | 40 wt % |
| Water | 60 wt % |
| Bubble generation liquid 2: | |
| Water | 100 wt % |
| Bubble generation liquid 3: | |
| Isopropyl alcohol | 40 wt % |
| Water | 60 wt % |
| Ejection liquid 1: | |
| Pigment ink (viscosity approximately 15 cP) | |
| Carbon black 5 | 5 wt % |
| Styrene-acrylic acid-ethyl acrylate copolymer (acid value 140 and weight average molecular weight 8000) | 1 wt % |
| Monoethanol amine | 0.25 wt % |
| Glycerine | 69 wt % |
| Thio diglycol | 5 wt % |
| Ethanol | 3 wt % |
| Water | 16.75 wt % |
| Ejection liquid 2 (viscosity 55 cP): | |
| Polyethylene glycol 200 | 100 wt % |
| Ejection liquid 3 (viscosity 150 cP): | |
| Polyethylene glycol 600 | 100 wt % |

Incidentally, with the liquids conventionally considered as not readily being ejected as described above, the shot accuracy of dot was poor conventionally on the recording sheet because of the low ejection speed and increased variations in the ejection directionality, and unstable ejection caused variations of ejection amounts, which made it difficult to obtain high-quality images. Against it, the structures of the above embodiments realized the satisfactory and stable generation of bubble using the bubble generation liquid. This resulted in an improvement in the shot accuracy of droplet and stabilization of ink ejection amount, thereby remarkably improving the quality of recording image.

<Liquid Ejecting Head Cartridge>

Next explained schematically is a liquid ejecting head cartridge incorporating the liquid ejecting head according to the above embodiment.

Figure 16:
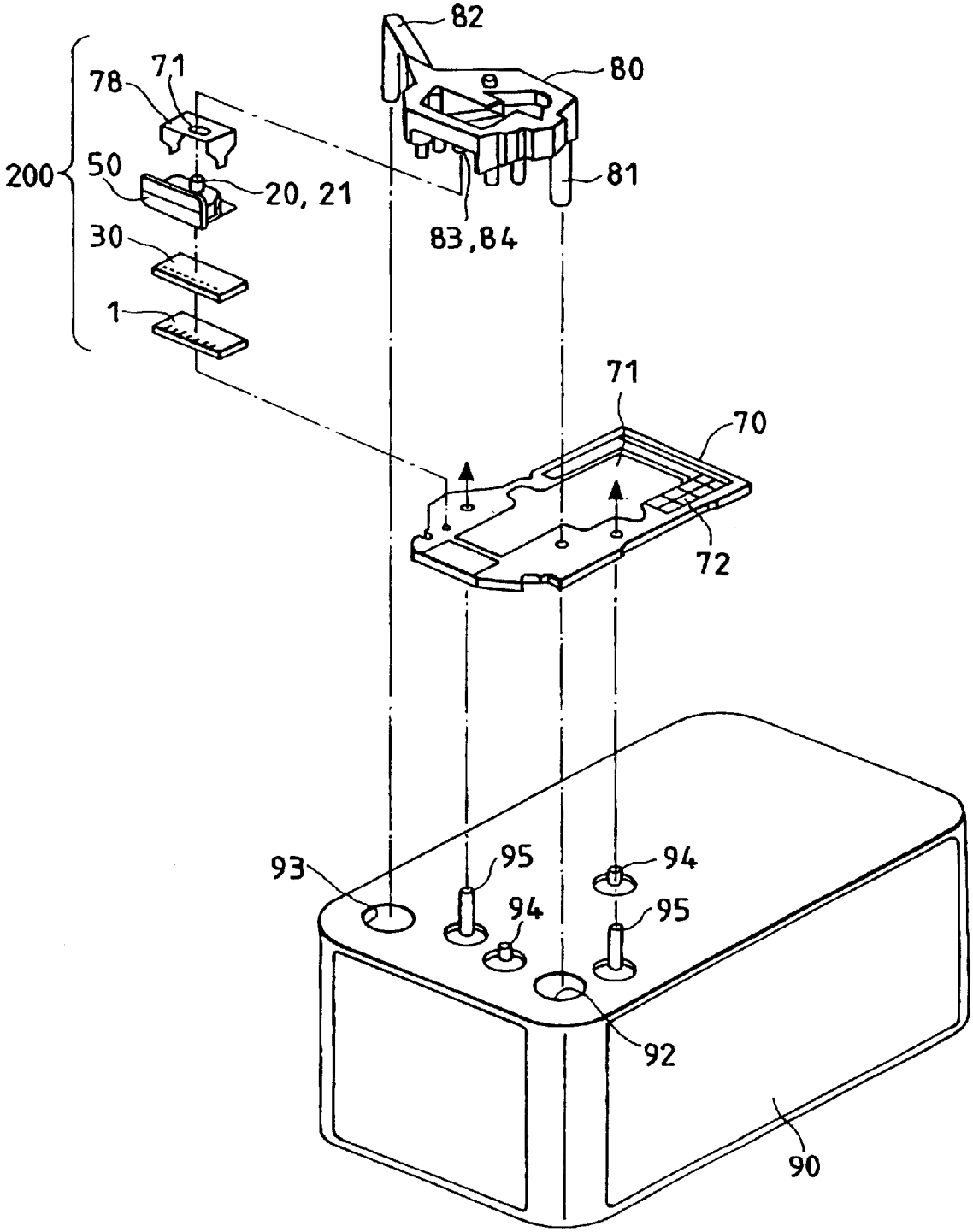
FIG. 16 is an exploded, perspective view of a liquid ejecting head cartridge.

FIG. 16 is a exploded, schematic, perspective view of the liquid ejecting head cartridge incorporating the above-stated liquid ejecting head, and the liquid ejecting head cartridge is generally composed mainly of a liquid ejecting head portion 200 and a liquid container 80.

The liquid ejecting head portion 200 comprises an element substrate 1, a partition wall 30, a grooved member 50, a presser bar spring 78, a liquid supply member 90, and a support member 70. The element substrate 1 is provided with a plurality of arrayed heat generating resistors for supplying heat to the bubble generation liquid, as described previously. Further, the substrate 1 is provided with a plurality of function elements for selectively driving the heat generating resistors. Bubble generation liquid passages are formed between the element substrate 1 and the aforementioned partition wall 30 having the movable walls, thereby allowing the bubble generation liquid to flow therein. This partition wall 30 is joined with the grooved top plate 50 to form ejection flow paths (not shown) through which the ejection liquid to be ejected flows.

The presser bar spring 78 is a member which acts to exert an urging force toward the element substrate 1 on the grooved member 50, and this urging force properly combines the element substrate 1, the partition wall 30, the grooved member 50, and the support member 70 detailed below in an incorporated form.

The support member 70 is a member for supporting the element substrate 1 etc. Mounted on this support member 70 are a circuit board 71 connected to the element substrate 1 to supply an electric signal thereto, and contact pads 72 connected to the apparatus side to transmit electric signals to and from the apparatus side.

The liquid container 90 separately contains the ejection liquid such as ink and the bubble generation liquid for generation of bubble, which are to be supplied to the liquid ejecting head. Outside the liquid container 90 there are positioning portions 94 for positioning a connecting member for connecting the liquid ejecting head with the liquid container, and fixing shafts 95 for fixing the connecting member. The ejection liquid is supplied from an ejection liquid supply passage 92 of the liquid container through a supply passage 84 of the connecting member to an ejection liquid supply passage 81 of the liquid supply member 80 and then is supplied through ejection liquid supply passages 83, 71, 21 of the respective members to the first common liquid chamber. The bubble generation liquid is similarly supplied from a supply passage 93 of the liquid container through a supply passage of the connecting member to a bubble generation liquid supply passage 82 of the liquid supply member 80 and then is supplied through bubble generation liquid supply passages 84, 71, 22 of the respective members to the second liquid chamber.

The above liquid ejecting head cartridge was explained with the supply mode and liquid container also permitting supply of different liquids of the bubble generation liquid and the ejection liquid, but, in the case wherein the ejection liquid and the bubble generation liquid are the same liquid, there is no need to separate the supply passages and container for the bubble generation liquid from those for the ejection liquid.

This liquid container may be refilled with a liquid after either liquid is used up. For this purpose, the liquid container is desirably provided with a liquid injection port. The liquid ejecting head may be arranged as integral with or separable from the liquid container.

<Liquid Ejecting Device>

Figure 17:
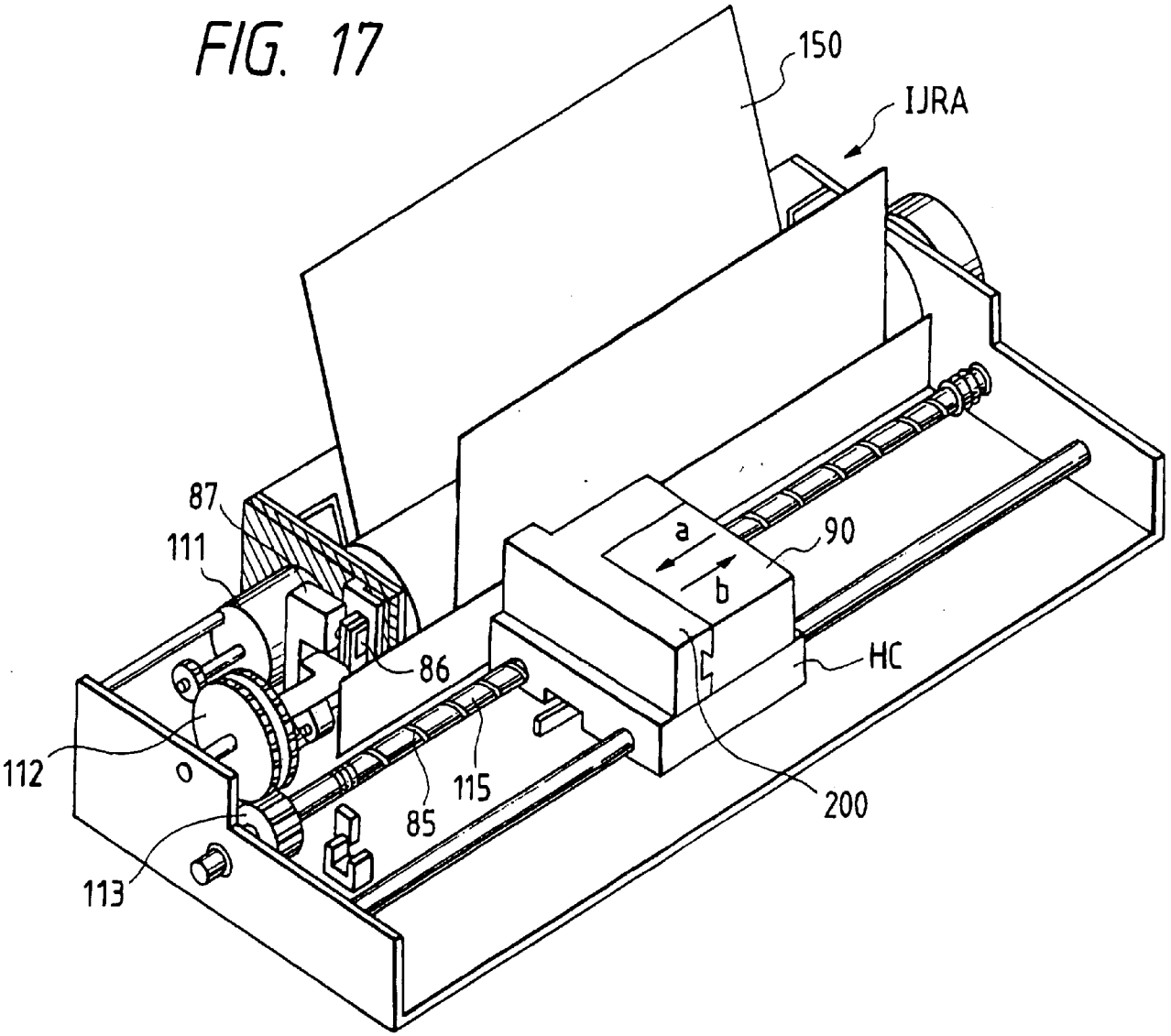
FIG. 17 is a schematic, structural drawing of a liquid ejecting device.

FIG. 17 shows the schematic structure of a liquid ejecting device incorporating the above-stated liquid jet head. The present embodiment will be explained especially with the ink ejection recording apparatus using the ink as the ejection liquid. A carriage HC of the liquid ejecting device carries a head cartridge in which liquid tank portion 90 containing the ink and liquid ejecting head portion 200 are detachable, and reciprocally moves widthwise of recorded medium 150 such as a recording sheet conveyed by a recorded medium conveying means.

When a driving signal is supplied from a driving signal supply means not shown to the liquid ejecting means on the carriage, the recording liquid is ejected from the liquid ejecting head to the recorded medium in response to this signal.

The liquid ejecting device of the present embodiment has a motor 111 as a driving source for driving the recorded medium conveying means and the carriage, and gears 112, 113 and a carriage shaft 115 for transmitting the power from the driving source to the carriage. By this recording device and the liquid ejecting method carried out therewith, recorded articles with good images were able to be attained by ejecting the liquid to various recording media.

Figure 18:
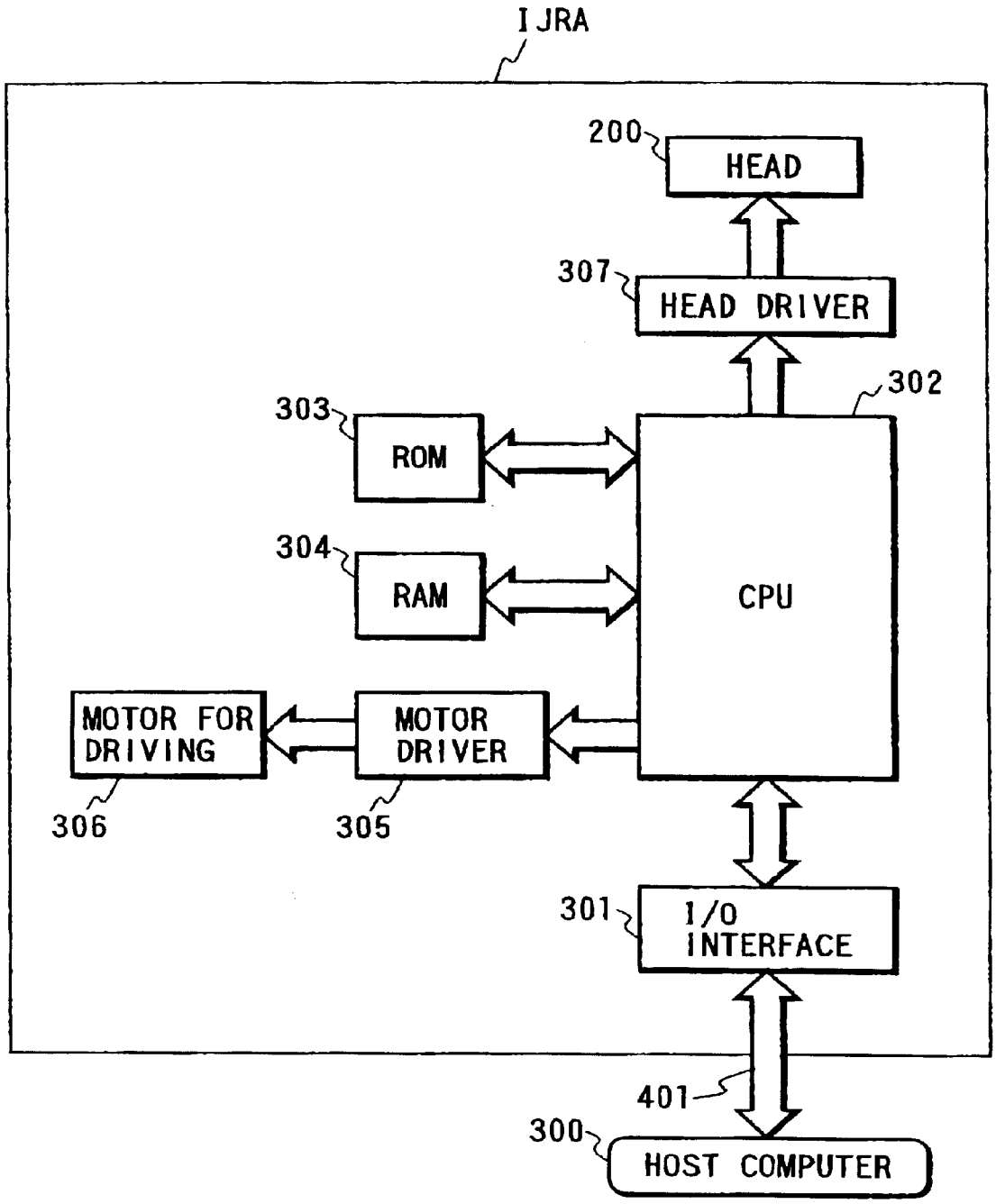
FIG. 18 is a device block diagram.

FIG. 18 is a block diagram of the whole of an apparatus for operating the ink ejecting device to which the liquid ejecting method and the liquid ejecting head of the present invention are applied.

The recording apparatus IJRA receives printing information as a control signal from a host computer 300. The printing information is temporarily stored in an input interface 301 inside the printing apparatus, and, at the same time, is converted into data processable in the recording apparatus. This data is input to a CPU 302 also serving as a head driving signal supply means. The CPU 302 processes the data thus received, using peripheral units such as RAM 304, based on a control program stored in ROM 303 in order to convert the data into printing data (image data).

In order to record the image data at an appropriate position on a recording sheet, the CPU 302 generates driving data for driving the driving motor for moving the recording sheet and the recording head in synchronization with the image data. The image data or the motor driving data is transmitted each through a head driver 307 or through a motor driver 305 to the head or to the driving motor 306, respectively, which is driven at each controlled timing to form an image.

Examples of the recorded media applicable to the above recording apparatus and capable of being recorded with the liquid such as ink include the following: various types of paper; OHP sheets; plastics used for compact disks, ornamental plates, or the like; fabrics; metals such as aluminum and copper; leather materials such as cowhide, pigskin, and synthetic leather; lumber materials such as solid wood and plywood; bamboo material; ceramics such as tile; and three-dimensional structures such as sponge.

The aforementioned recording apparatus includes a printer apparatus for recording on various types of paper and OHP sheet, a plastic recording apparatus for recording on a plastic material such as a compact disk, a metal recording apparatus for recording on a metal plate, a leather recording apparatus for recording on a leather material, a wood recording apparatus for recording on wood, a ceramic recording apparatus for recording on a ceramic material, a recording apparatus for recording on a three-dimensional network structure such as sponge, a textile printing apparatus for recording on a fabric, and so on.

The ejection liquid used in these liquid ejecting apparatus may be properly selected as a liquid matching with the recorded medium and recording conditions employed.

<Recording System>

Next explained is an example of an ink jet recording system using the liquid ejecting head of the present invention as a recording head, for performing recording on a recorded medium.

Figure 19:
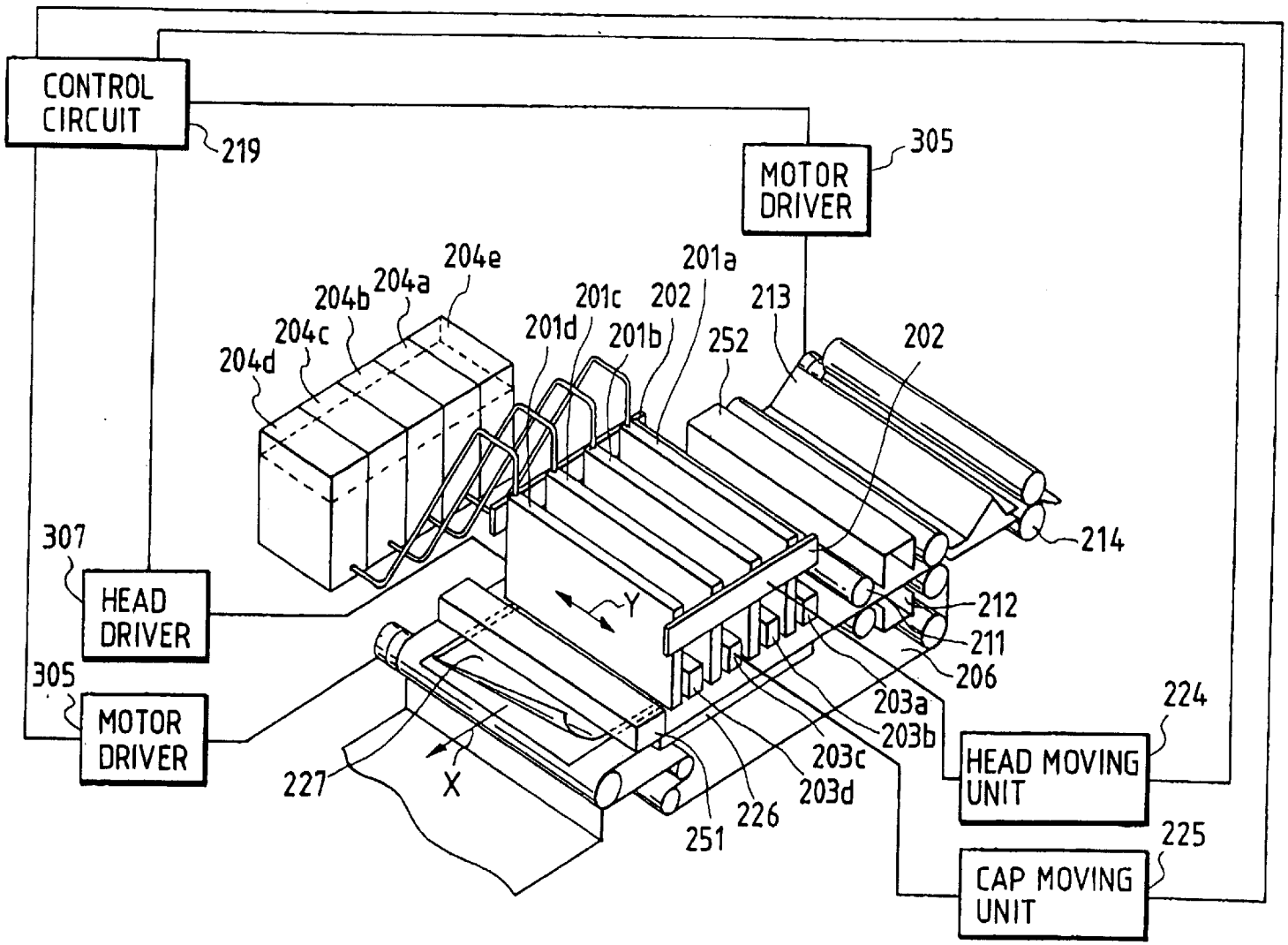
FIG. 19 is a drawing to show a liquid ejection recording system.

FIG. 19 is a schematic drawing for explaining the structure of the ink jet recording system using the liquid ejecting head 201 of the present invention described above. The liquid ejecting head in the present embodiment is a full-line head having a plurality of ejection outlets aligned in the density of 360 dpi so as to cover the entire recordable range of the recorded medium 150. The liquid ejecting head comprises four head units corresponding to four colors of yellow (Y), magenta (M), cyan (C), and black (Bk), which are fixedly supported by holder 202 in parallel with each other and at predetermined intervals in the X-direction.

A head driver 307 constituting the driving signal supply means supplies a signal to each of these head units to drive each head unit, based on this signal.

The four color inks of Y, M, C, and Bk are supplied as the ejection liquid to the associated heads from corresponding ink containers 204*a*–204*d*. Reference symbol 204*e* designates a bubble generation liquid container containing the bubble generation liquid, from which the bubble generation liquid is supplied to each head unit.

Disposed below each head is a head cap 203*a*, 203*b*, 203*c*, or 203*d* containing an ink absorbing member comprised of sponge or the like inside. The head caps cover the ejection outlets of the respective heads during non-recording periods so as to protect and maintain the head units.

Reference numeral 206 denotes a conveyer belt constituting a conveying means for conveying a recorded medium selected from the various types of media as explained in the preceding embodiments. The conveyor belt 206 is routed in a predetermined path via various rollers and is driven by a driving roller connected to a motor driver 305.

The ink jet recording system of this embodiment comprises a pre-process apparatus 251 and a post-process apparatus 252, disposed upstream and downstream, respectively, of the recorded medium conveying path, for effecting various processes on the recorded medium before and after recording.

The pre-process and post-process may include different process contents depending upon the type of recorded medium and the type of ink used in recording. For example, when the recorded medium is one selected from metals, plastics, and ceramics, the pre-process may be exposure to ultraviolet radiation and ozone to activate the surface thereof, thereby improving adhesion of ink. If the recorded medium is one likely to have static electricity such as plastics, dust will be easy to attach to the surface because of the static electricity, and this dust would sometimes hinder good recording. In that case, the pre-process may be elimination of static electricity in the recorded medium using an ionizer, thereby removing the dust from the recorded medium. If the recorded medium is a fabric, the pre-process may be a treatment to apply a material selected from alkaline substances, water-soluble substances, synthetic polymers, water-soluble metal salts, urea, and thiourea to the fabric in order to prevent blot and to improve the deposition rate. The pre-process does not have to be limited to these, but may be any process, for example a process to adjust the temperature of the recorded medium to a temperature suitable for recording.

On the other hand, the post-process may be, for example, a heat treatment of the recorded medium with the ink deposited, a fixing process for promoting fixation of the ink by ultraviolet radiation or the like, a process for washing away a treatment agent given in the pre-process and remaining without reacting.

The present embodiment was explained using the full-line head as the head, but, without having to be limited to this, the head may be a compact head for effecting recording as moving in the widthwise direction of the recorded medium, as described previously.

The present invention is also applicable to heads of the side shooter type having ejection outlets located opposite to the heat generating element surface.

In the heads and recording apparatus etc. according to the present invention, the head cartridge having the ejecting head as described above can be used as replacing the conventional products and, in the case of recording being carried out by the conventional recording apparatus, recording can also be made with the ejecting head enjoying the various effects described below.

With the structure of the present invention, the head can be mounted on a plurality of devices of types for supplying different electric energy amounts to the head. This facilitates supply of high-performance heads to the market and also allows energy saving of the whole apparatus to be achieved by just changing the head.

With the liquid ejecting method, head, etc. based on the novel ejection principle using the movable members as described above, the synergistic effect of the bubble generated and the movable member displaced thereby can be achieved, so as to enable the liquid near the ejection outlet to be ejected efficiently, which increases the ejection efficiency as compared with the conventional ejecting methods, heads, etc. of the bubble jet type.

Further, with the characteristic structure of the present invention, ejection failure can be prevented even after long-term storage at low temperature or at low humidity, or, even if ejection failure occurs, the head can be advantageously returned instantly into the normal condition only with a recovery process such as preliminary ejection or suction recovery. With this advantage, the invention can reduce the recovery time and losses of the liquid due to recovery, and thus can greatly decrease the running cost.

Especially, the structure of the present invention improving the refilling characteristics attained improvements in responsivity during continuous ejection, stable growth of bubble, and stability of liquid droplet, thereby enabling high-speed recording or high-quality recording based on high-speed liquid ejection.

In the head of the two-flow-path structure the freedom of selection of the ejection liquid was raised by use of a liquid likely to generate a bubble or a liquid unlikely to form the deposits (scorching or the like) on the heat generating element, as the bubble generation liquid, and the head of the two-flow-path structure was able to well eject even the liquid that the conventional heads failed to eject in the conventional bubble jet ejection method, for example, the high-viscosity liquid unlikely to generate a bubble, the liquid likely to form the deposits on the heat generating element, or the like.

The present invention provided the liquid ejecting device, the recording system, etc. that were further improved in the ejection efficiency of liquid and the like, using the liquid ejecting head according to the present invention.

In the case of the area of heat generating element being decreased as described above, adjustment is necessary in the initial step in the process for fabricating the head, and thus studies on design are necessitated; but it is advantageous in respect of the cost, because it requires no circuit for converting the voltage or the like.

What is claimed is:

1. A liquid ejecting head having an ejection outlet for ejecting a liquid, a liquid flow path in fluid communication with said ejection outlet, and an ejection energy generating element, disposed corresponding to said liquid flow path, for generating ejection energy responsive to application of a drive signal, said liquid ejecting head comprising:

adjusting means for adjusting a voltage of the drive signal to a predetermined voltage, for driving said ejection energy generating element, the drive signal being supplied from outside of said liquid ejecting head to said liquid ejecting head; and driving means for driving said ejection energy generating element based upon a recording signal input from outside of said liquid ejecting head, said driving means driving said ejection energy generating element by the drive signal whose voltage was adjusted by said adjusting means.

2. A liquid ejecting head according to claim 1, wherein said liquid ejecting head can be mounted replaceably on a plurality of devices.

3. A liquid ejecting head according to claim 1, wherein said ejection energy generating element comprises a heat generating element, said heat generating element supplying thermal energy to the liquid supplied into said liquid flow path to generate a bubble therein, thereby to eject the liquid through said ejection outlet by pressure upon generation of the bubble.

4. A liquid ejecting head according to claim 1, wherein ink is ejected as the liquid.

5. A head cartridge comprising the liquid ejecting head as set forth in claim 1, and a liquid container for reserving the liquid to be supplied to said liquid ejecting head.

6. A liquid ejecting device comprising the liquid ejecting head as set forth in claim 1, and energy supplying means for supplying the energy to said liquid ejecting head.

7. A liquid ejecting head according to claim 1, wherein said adjusting means comprises a voltage converter that includes a voltage divider, and which converts a voltage of the drive signal.

8. A liquid ejecting head according to claim 1, wherein said adjusting means comprises a voltage converter that includes a DC-DC converter, and which converts a voltage of the drive signal.

9. A liquid ejecting head having an ejection outlet for ejecting a liquid, a heat generating element for applying heat to the liquid to generate a bubble in the liquid, and a movable member disposed so as to face said heat generating element, having a free end toward the ejection outlet, and arranged for displacement of said free end responsive to pressure resulting from generation of the bubble, thereby to guide the pressure to in a direction of the ejection outlet, said liquid ejecting head comprising:

adjusting means for adjusting a voltage of an electrical signal to a predetermined voltage for use as a drive signal in driving said heat generating element, the drive signal being supplied from outside of said liquid ejecting head to said liquid ejecting head; and driving means for driving said heat generating element based upon a recording signal input from outside of said liquid ejecting head, said driving means driving said heat generating element by the drive signal whose voltage has been adjusted by said adjusting means.

10. A liquid ejecting head according to claim 9, wherein said free end of said movable member is located downstream of a center of an area of said heat generating element.

11. A liquid ejecting head according to claim 9, wherein the bubble is a bubble generated when film boiling is caused in the liquid by the heat applied by said heat generating element.

12. A liquid ejecting head according to claim 9, wherein said movable member is of a plate shape.

13. A liquid ejecting head according to claim 9, wherein said movable member is constructed as a part of a partition wall disposed between a first flow path and a second flow path.

14. A liquid ejecting head according to claim 9, wherein said adjusting means comprises a voltage converter which includes a voltage divider, and which adjusts a voltage of the drive signal.

15. A liquid ejecting head according to claim 9, wherein said adjusting means comprises a voltage converter which includes a DC-DC converter, and which adjusts a voltage of the drive signal.

16. A head cartridge comprising the liquid ejecting head as set forth in claim 9, and a liquid container for reserving the liquid to be supplied to said liquid ejecting head.

17. A liquid ejecting device comprising the liquid ejecting head as set forth in claim 9, and energy supplying means for supplying energy to the liquid ejecting head.

18. A recording system comprising the liquid ejecting device as set forth in claim 17, further comprising means for replaceably mounting said liquid ejecting head, wherein said liquid ejecting head outputs an identification signal indicating a type of the liquid ejecting head mounted, and wherein said liquid ejecting device has controlling means for identifying the type of the liquid ejecting head based on the presence or absence of the identification signal and the contents of the identification signal and for controlling a width of a pulse signal supplied to said liquid ejecting head in accordance with the type identified.

* * * * *